US011148917B2

(12) United States Patent
Verbeek

(10) Patent No.: US 11,148,917 B2
(45) Date of Patent: Oct. 19, 2021

(54) MULTIFUNCTIONAL SYSTEM FOR THE SELF-RECOVERY OF WHEELED VEHICLES

(71) Applicant: BUSH WINCHES AND ANCHORS PTY LTD, Subiaco (AU)

(72) Inventor: Patrick Verbeek, Subiaco (AU)

(73) Assignee: BUSH WINCHES AND ANCHORS PTY LTD, Subiaco (AU)

( * ) Notice: Subject to any disclaimer, the term of this patent is extended or adjusted under 35 U.S.C. 154(b) by 274 days.

(21) Appl. No.: 16/085,784

(22) PCT Filed: Mar. 16, 2017

(86) PCT No.: PCT/AU2017/000080
§ 371 (c)(1),
(2) Date: Sep. 17, 2018

(87) PCT Pub. No.: WO2017/156571
PCT Pub. Date: Sep. 21, 2017

(65) Prior Publication Data

US 2019/0039865 A1 Feb. 7, 2019

(30) Foreign Application Priority Data

Mar. 15, 2016 (AU) ..... 2016900997

(51) Int. Cl.
*B66D 1/00* (2006.01)
*B66D 1/36* (2006.01)

(52) U.S. Cl.
CPC ..... *B66D 1/005* (2013.01); *B66D 1/00* (2013.01); *B66D 1/36* (2013.01); *B66D 1/365* (2013.01)

(58) Field of Classification Search
CPC . B66D 1/005; B66D 1/00; B66D 1/36; B66D 1/365
See application file for complete search history.

(56) References Cited

U.S. PATENT DOCUMENTS 1,207,793 A * 12/1916 Ramstad ..... B66D 1/005 242/392
1,287,620 A * 12/1918 Benson ..... B66D 1/005 242/392

(Continued)

FOREIGN PATENT DOCUMENTS

AU 2005229160 B2 7/2009
CN 103818839 A 5/2014

(Continued)

OTHER PUBLICATIONS

International Search Report dated Sep. 28, 2017 for corresponding International Application No. PCT/AU2017/000080, filed Mar. 16, 2017.

(Continued)

*Primary Examiner* — Michael E Gallion
(74) *Attorney, Agent, or Firm* — David D. Brush; Westman, Champlin & Koehler, P.A.

(57) ABSTRACT

A multi-functional system for the self-recovery of a wheeled vehicle. The system includes: a dished adaptor plate permanently fixed to a driven wheel of a vehicle by capturing beneath the wheel retaining bolts or nuts; a drum plate driven in rotation directly by the adaptor plate or indirectly via a driven plate driven in rotation by the adaptor plate and by a torque-transmitting appliance situated between the driven plate and the drum plate; complementary attachment elements provided on the drum plate and the drum permitting the rapid attachment of the drum to the drum plate; a tow cable fixed to and wound around the drum and led off to a secure anchor point such that subsequent driving of the wheel in the appropriate rotational sense applying tension to the tow cable, thereby assisting in recovery of the vehicle.

34 Claims, 11 Drawing Sheets

(56) References Cited

U.S. PATENT DOCUMENTS 1,480,035 A * 1/1924 Warrick ..... 242/392
1,526,206 A * 2/1925 Dominguez, Jr. ..... 242/392
1,941,250 A * 12/1933 Dale ..... B66D 1/36 242/157.1
2,240,570 A * 5/1941 Oesterheld ..... B66D 1/005 242/392
2,527,634 A * 10/1950 Groves ..... B65H 75/425 242/392
2,642,235 A * 6/1953 Smith ..... B66D 1/005 242/392
2,751,193 A * 6/1956 Loomis ..... B66D 1/005 242/392
3,099,416 A * 7/1963 Wright ..... B66D 1/005 242/392
3,132,823 A * 5/1964 Hrvoje ..... B66D 1/005 242/392
3,688,522 A 9/1972 Schmuck
3,917,228 A * 11/1975 Blum ..... B66D 1/005 242/392
4,135,681 A * 1/1979 Cooper ..... B66D 1/005 180/7.5
4,291,847 A * 9/1981 Gilbert ..... B60K 25/08 242/392
4,568,036 A * 2/1986 Kearney ..... B66D 1/005 242/392
4,778,126 A * 10/1988 Spann, Jr. ..... B66D 1/005 180/7.5
5,054,745 A * 10/1991 Swayze ..... B66D 3/046 254/325
5,115,994 A * 5/1992 Hershberger ..... B66D 1/005 242/392
D385,079 S * 10/1997 Griffin ..... D34/33
6,375,110 B1 * 4/2002 Ofer ..... B66D 1/005 242/392
7,107,654 B2 9/2006 Byers
7,455,257 B1 * 11/2008 Kaleta ..... B63C 11/02 242/397.3
9,821,986 B2 * 11/2017 Chen ..... B66D 1/005
2003/0047725 A1 * 3/2003 Borgoglio ..... B66D 1/005 254/213
2004/0084663 A1 * 5/2004 Van Cor ..... B66D 1/005 254/323
2009/0236576 A1 * 9/2009 Chou ..... B66D 1/005 254/323
2011/0174913 A1 * 7/2011 Smith ..... B66D 1/005 242/392
2017/0081157 A1 * 3/2017 Chen ..... B66D 1/005

FOREIGN PATENT DOCUMENTS

DE 2653761 A1 6/1978
DE 2835012 A1 2/1980
DE 10118028 A1 2/2002
GB 704113 A 2/1954
GB 990884 A 5/1965
GB 2279635 A 1/1995
GB 2283987 A 5/1995
GB 2366275 A 3/2002
WO 2005095257 A1 10/2005
WO 2014176642 A1 11/2014

OTHER PUBLICATIONS

Written Opinion of the International Searching Authority dated Sep. 28, 2017 for corresponding International Application No. PCT/AU2017/000080, filed Mar. 16, 2017.

* cited by examiner

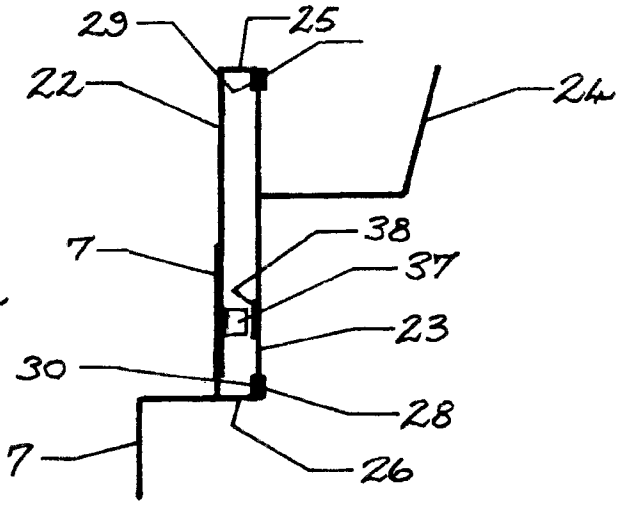
Fig 5
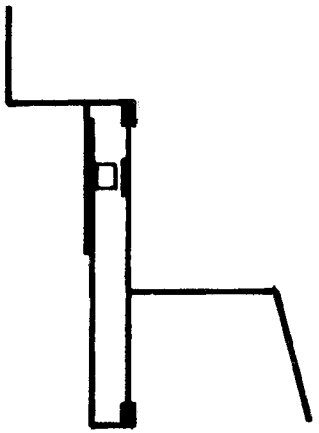
Fig 4
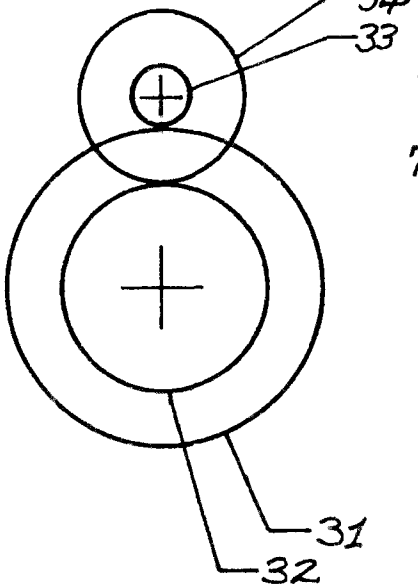
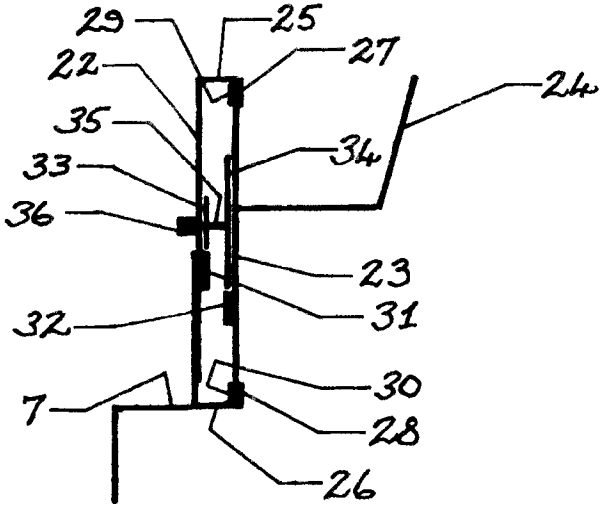
Fig 3
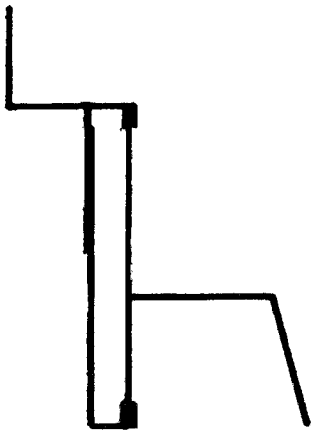

91
94
92
96
104
105
103
101
102
100
93
95
96
110
99
97
98
107
109
108
111
118
113
112
114
116
115
117
82
106

MULTIFUNCTIONAL SYSTEM FOR THE SELF-RECOVERY OF WHEELED VEHICLES

CROSS-REFERENCE TO RELATED APPLICATIONS

This Application is a Section 371 National Stage Application of International Application No. PCT/AU2017/000080, filed Mar. 16, 2017, the content of which is incorporated herein by reference in its entirety, and published as WO 2017/156571 on Sep. 21, 2017, in English.

FIELD OF THE DISCLOSURE

This invention relates generally to methods of recovering wheeled vehicles which, for various reasons, have lost traction. Specifically, it relates to winching means fixed to and driven directly by powered wheels of a vehicle.

BACKGROUND OF THE DISCLOSURE

In the operation of wheeled vehicles on unprepared surfaces or in snow, ice or other conditions in which traction is compromised, it is frequently necessary to recover a bogged or immobilised vehicle. Because of their small footprint and relatively high ground contact pressure, the wheels of wheeled vehicles tend to sink into and become bogged in soft ground and frequently lose traction on inclined surfaces covered with mud, snow or ice. The resultant immobilisation necessitates the use of recovery means. Where a vehicle cannot be towed from such a situation, it is common for self-recovery to be effected by winching. In this method, a cable from the drum of a power-driven winch fixed to the vehicle structure is led off to a suitable anchor point and the winch operated to bodily drag the vehicle onto a sound surface. While such winches are effective, they may be expensive to purchase and install, are largely a redundant weight to be carried continuously and their weight may adversely affect the weight distribution of a vehicle.

Verbeek, in AU 2005229160, teaches the attachment in various ways to pairs of driven wheels of a vehicle of winching means incorporating a drum, cables being led off from said drums to suitable anchor points and power being applied to said driven wheels in the appropriate sense to urge the vehicle in the desired direction. Sprenger, in DE 2653761, teaches the use of a self-recovery system for an agricultural tractor and the like, the recovery system comprising a drum fixed to a housing temporarily attached to a driving wheel preferably by four equally spaced gripping rods of adjustable position, the gripping rods having bracket-shaped free ends to grip the driving wheel tread, the rope being attached to the drum at one end and a suitable anchor at the other. Schweikert, in DE2835012, teaches the use of a rope winch for the self-recovery of cars and small commercial vehicles, the winch comprising two plates secured together by bolts around which a rope is wound, the rope being attached to the winch assembly which is secured by sleeves to the vehicle wheel nuts, the wheel nuts acting as driving members. Askew, in GB 2366275, teaches the use of a vehicle self-recovery winch employing a strap which is wound under the wheels of a vehicle, the strap being secured to a wheel by means of a removable wheel bar fixed to the wheel-securing bolts and led off to a suitable anchor. Neath, in GB 2383987, teaches the use of a wheel winch unit for the self-recovery of vehicles, the winch unit being secured to any of the vehicle wheels using modified wheel locking bolts, a wire rope connected to the winch hub being attached to a suitable anchorage point, rewinding of the rope using the driving wheel of the vehicle effecting recovery, the winch then being removed and the standard wheel locking bolts replaced. Birch, in GB 990884, teaches the use of a winch drum for self-recovery of a vehicle, the winch drum being designed for attachment to a vehicle road wheel and having an outer cable-retaining flange comprising a rim to which are fixed radial strips, the strips extending axially over a sleeve, some being further extended to provide lugs for attachment of the drum to a wheel by means of the wheel nuts, a rope or cable being led off to a suitable anchor. Aubin, in WO 2014/176642, teaches the use of a vehicle recovery device which includes a ladder-like flexible harness assembly made from various materials and having a pair of flexible, elongate longitudinal members and a number of transverse members provided between the pair of longitudinal members in order to space the longitudinal members apart, both ends of the flexible harness assembly being provided with an attachment capability to attach the harness assembly to an external anchor point or to another portion of the harness assembly, the assembly being attachable to a driven wheel of a vehicle for using the wheel as a winch drum or spool, driving the vehicle towards the anchor point causing at least one wheel to act as a winch drum to take up the harness assembly.

All of the cited prior art examples suffer from inconvenience in application. In the winching means of Verbeek, the original vehicle wheels or wheel attachment bolts must be permanently modified. In the system of Sprenger, it may be necessary to raise the vehicle wheels in order to engage the gripping rods, the gripping rods may not engage tyres heavily fouled with mud and the mechanism for adjusting the positions of the gripping rods may be rendered inoperative by fouling with mud, soil or stones. The winch of Schweikert are bolted to sleeves which must previously have been bolted to the wheel of a vehicle, the sleeves possibly impeding engagement of wheel bolts with their tapered seatings, threaded bolt apertures possibly becoming corroded or fouled by mud and sand. The vehicle recovery device of Askew may require raising of the wheels of a bogged vehicle in order to position the strap and the wheel bars must be bolted to the wheels and subsequently removed. The wheel winch of Neath requires the use of modified wheel bolts. The recovery unit of Birch must be bolted to a wheel before use. The vehicle recovery device of Aubin must be tied to a wheel before use; a difficult task where a wheel is bogged and heavily fouled.

SUMMARY

The principal object of the present invention is to provide winching means incorporating a drum attachable to pairs of driven wheels of a vehicle and being quickly and readily adaptable to a broad range of wheel types and employed in almost any operational situation; said winching means being low in cost, low in weight, easily installed and removed and compact and convenient to store in a vehicle. Secondary objects of the present invention are to provide manually-powered, independent rotation of a drum to take up slack in a tow cable; to provide spring-driven, independent rotation of a drum to take up slack in a tow cable; to drive a drum at a speed different from that of a driven wheel; to provide buffer springs in said winching means to ameliorate shock loadings; to incorporate clutch means (torque transmitting mechanism) into said winching means to ensure load-sharing between driven wheels; to provide quickly-engaged guiding means (tow cable guide) to guide a cable past the wheels of a vehicle not incorporating said winching means; and to provide a coil guide to ensure spooling of the coils of said tow cable from said drum when said tow cable and drum plane are misaligned.

According to the present invention, an adaptor plate is made to be fixed to a broad range of wheel types using the existing wheel attachment bolts or stud and nut combinations which are not thereby compromised. Said adaptor plate incorporates attachment means (fasteners) of various forms to attach to it the drum of said winching means or, where employed, a driven plate to which is attached said drum. Where said combination of driven plate and drum is employed, the two said components are adapted to accommodate between them ratchet means (slack collector) to allow manually-powered, independent rotation of a drum to take up slack in a tow cable; spring means to provide spring-driven, independent rotation of a drum to take up slack in a tow cable; gearing means to drive a drum at a rotational speed different from that of a driven wheel; spring means to provide buffering to ameliorate shock loadings; and clutch means (torque transmitting mechanism) to ensure load-sharing between driven wheels. Quickly-engaged guiding means (tow cable guide) are provided to guide a cable past the wheels of a vehicle not incorporating said winching means; a coil guide is provided to prevent escape of coils of said cable from said drum when said cable and drum plane are misaligned; and discrete means (slack collector) to provide spring-driven taking up of slack in a tow cable.

BRIEF DESCRIPTION OF THE DRAWINGS

The various aspects of the present invention will be more readily understood by reference to the following description of preferred embodiments given in relation to the accompanying drawings in which:

FIG. 3 is a schematic transverse view through a diameter of an embodiment of the present invention;

FIG. 4 is a face schematic view of a gear train of the embodiment of FIG. 3;

FIG. 5 is a schematic transverse view through a diameter of an embodiment of the present invention;

DETAILED DESCRIPTION OF ILLUSTRATIVE EMBODIMENTS

No significance should be taken from the fact that the drawings are drawn to differing scales.

It should be noted that, in some figures, for the purpose of clarity of exposition, clearances between components have been exaggerated.

Figure 1:
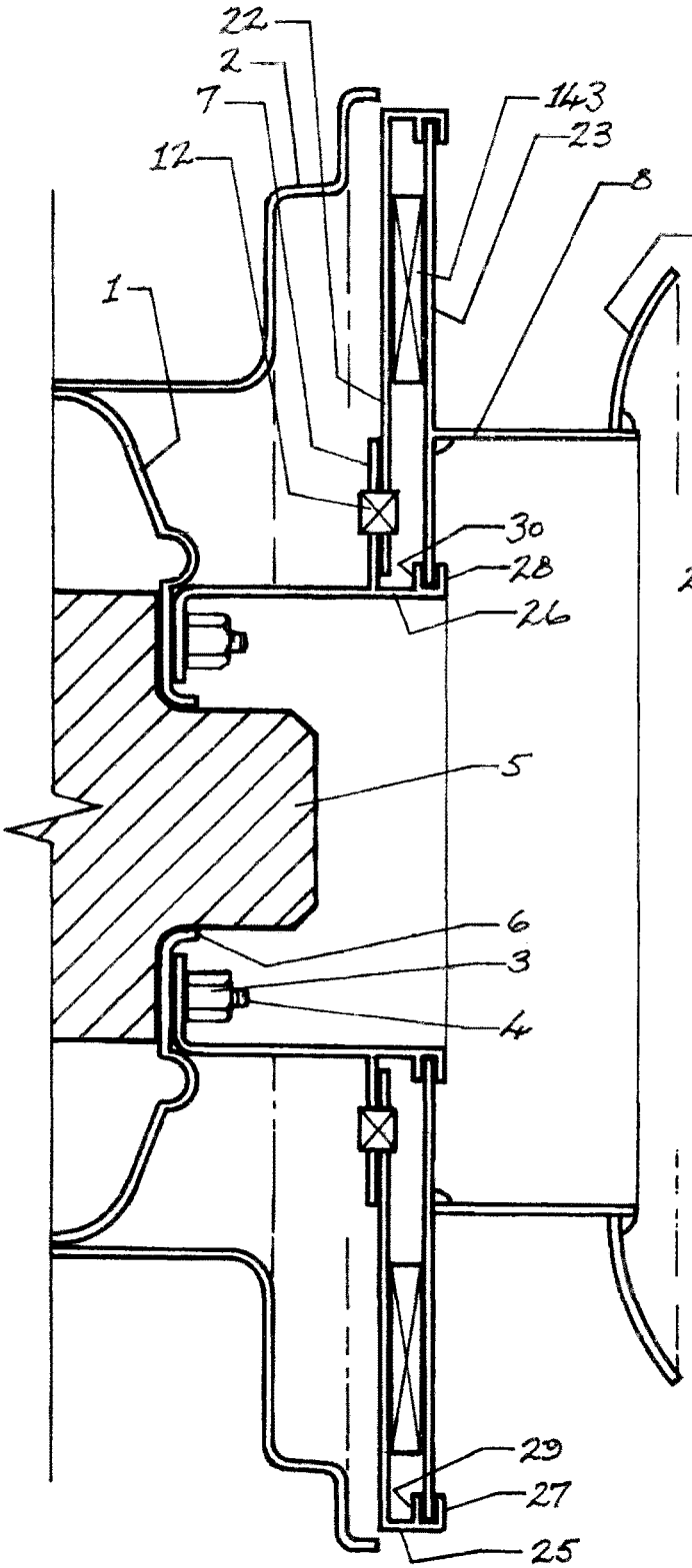
FIG. 1 is a partial transverse cross-sectional view through a diameter of a wheel fitted with the present invention, some components being shown schematically.

With reference to FIG. 1, a wheel 1 of a wheeled vehicle has fixed to it adaptor plate 7, said adaptor plate being imprisoned beneath wheel securing nuts 3 screwed and tightened onto wheel attachment studs 4 or screwed and tightened into threaded bores (not shown) of hub 5. Drum 8, with flange 10 fixed to its outer periphery, is fixed to circular drum plate 23. Circular driven plate 22 is removably fixed to said adaptor plate by a plurality of attachment means (fasteners) 12 which take one of the several forms described herein. The depth of dishing of said adaptor plate is preferably sufficient to allow said driven plate and said drum plate to be supported outside wheel rim 2. Said adaptor plate is provided at its inner part with first outwardly projecting, cylindrical extension 26, short raised flange 30 being formed adjacent and parallel to the outer edge of said first extension. Said driven plate is provided at its outer edge with second outwardly projecting, cylindrical extension 25, short raised flange 29 being formed adjacent and parallel to the outer edge of said second extension. Said raised flanges are disposed towards each other, their outer faces being situated in a common plane disposed parallel to said driven plate. The peripheral edges of drum plate 23 make an easy sliding clearance with the opposed surfaces of said cylindrical extensions and are captured between said first and second raised flanges by annular retaining rings 27, 28 fixed to said cylindrical extensions by a plurality of suitable fasteners (not shown). Said first and second cylindrical extensions are made sufficiently thick to accommodate said fastenings (fasteners). The location of a typical said fastening is depicted as 30 in FIG. 6. The space between the outer surfaces of flanges 30, 29 and the inner surfaces of retaining rings 27, 28 is such that said drum plate is able to rotate independently of said driven plate. In an alternative embodiment (not shown), thin washers of metal or a suitable hard polymer material are positioned to either side of the peripheral inner and outer edges of said drum plate between said drum plate and said retaining rings. Torque transmitting means (torque transmitting mechanism) 143 taking one of the several forms described herein are provided between said driven plate and said drum plate. Said wheel is centred on said hub by edge 6 of the central aperture of said wheel abutting the circumferential surfaces of the protruding central boss of said hub or other raised surface provided for the purpose. In an alternative embodiment (not shown), said drum comprises inner and outer flanges, being moulded in monolithic form from a suitable engineering polymer material and made integral with said drum plate made from a suitable metal material. Obviously, in circumstances in which it is desirable for said drum to always turn at the same rotational speed as said wheel, said driven plate and said drum plate may be locked together, or where such an arrangement is to be made permanent, said first and second cylindrical extensions, said raised flanges, said retaining rings and said torque transmission means may be deleted and said driven plate and said drum plate combined into a single plate fixed to said adaptor plate. In the preferred embodiment, said driven plate is removably fixed to said adaptor plate by means of the engagement of a plurality of equally-spaced studs having enlarged heads (of the type depicted as 67 and 68 in FIG. 15) fixed to the inner surface of said driven plate 23 with a plurality of complementary, equally-spaced, double keyhole-type apertures Said apertures comprise a larger, centrally-located aperture from which extend short, elongated, circumferentially-arranged, narrow apertures (of the type depicted as 65 and 66 in FIG. 13); said studs and said apertures being positioned on circles of the same diameter centred on the axis of rotation of said wheel. Said driven plate is fixed to said adaptor plate by passing said heads of said studs through said apertures and rotating said drum such that said studs enter the appropriate said narrow apertures. To prevent rotation of said driven plate in relation to said adaptor plate and, as a result, inadvertent detachment of said driven plate, a ball-lock pin having a hardened shank is optionally inserted through apertures (of the type depicted as 69 and 70 in FIGS. 13 and 14) brought into coincidence by correct positioning of said driven plate on said adaptor plate. Obviously, said double keyhole-type apertures may be provided in said driven plate and said studs on the external surface of said adaptor plate. Said apertures to accommodate said ball-lock pin are optionally provided to lock said driven plate in position on said adaptor plate by rotation either in a clockwise or counter-clockwise direction. Obviously, said larger apertures may each be made with only one appropriately-orientated, circumferentially-arranged, narrow aperture. In operation, the end of a tow cable is fixed to said drum, wound onto said drum and led off to a suitable anchor point, subsequent rotation of said wheel resulting in the application of tension to said tow cable, said tension assisting in recovery of said vehicle. In the preferred embodiment, a loop at the end of said tow cable is passed around a suitable metal eye and swaged, said eye being fixed by a suitable fastening to said drum.

Figure 2:
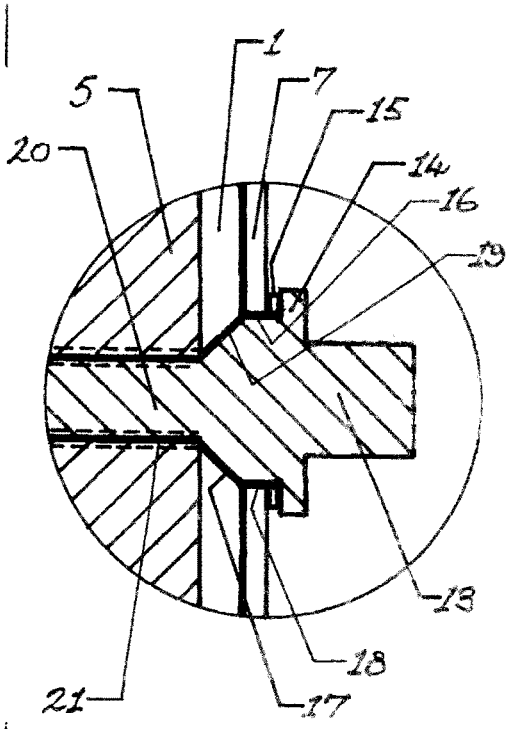
FIG. 2 is a fragmentary longitudinal cross-sectional view of a wheel securing bolt adapted for use with the present invention.

With additional reference to FIG. 2, bolt 20 is screwed and tightened into threaded bore 21 in hub 5, tapered face 17 formed on the shank of said bolt wedgingly engaging tapered recess 19 formed in wheel 1. Cylindrical surface 18 formed on the shank of said bolt makes a light sliding fit with aperture 16 formed in adaptor plate 7, spring washer 15 being urged by flange 14 against said adaptor plate, thereby urging said adaptor plate against said wheel. Head 13 of said bolt is adapted to be gripped by a suitable tool. In an alternative embodiment (not shown), said bolt is replaced by a nut screwed and tightened onto stud 4, said nut being provided with tapered face 17 and cylindrical surface 18.

Figure 6:
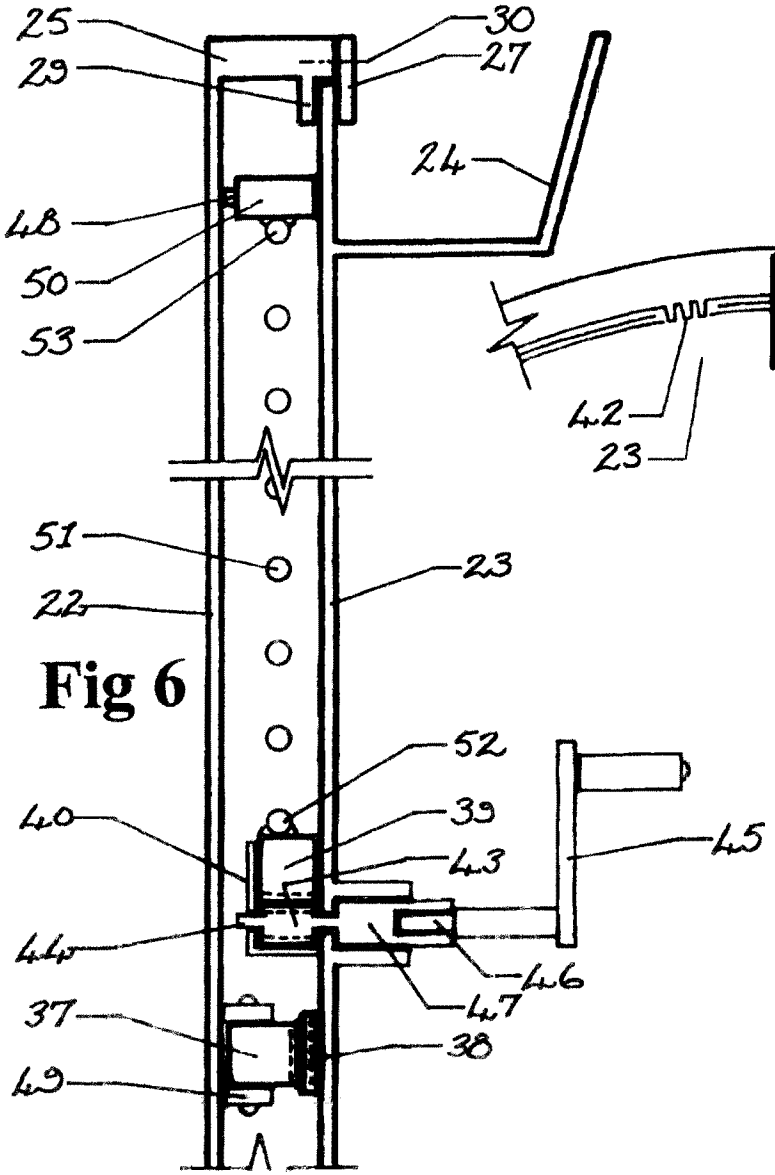
FIG. 6 is a partial transverse cross-sectional view through a diameter of an embodiment of the present invention.

With reference to FIGS. 3, 4 and 6, adaptor plate 7 is fixed to the wheel of a vehicle in the manner described herein. Circular driven plate 22 is removably attached to said adaptor plate by one of the several attachment means described herein. Said adaptor plate is provided at its inner part with first outwardly disposed and circular, cylindrical extension 26. Said driven plate is provided at its outer edge with second outwardly disposed and circular, cylindrical extension 25. Adjacent and parallel to the outer edge of cylindrical extension 26 is formed short raised flange 30. Adjacent and parallel to the outer edge of cylindrical extension 25 is formed short raised flange 29. Said raised flanges are disposed towards each other, their outer faces being situated in a common plane, disposed parallel to said driven plate. The peripheral edges of circular drum plate 23 make an easy sliding clearance with the opposed surfaces of said cylindrical extensions and are captured between raised flanges 30 and 29 by annular retaining rings 27, 28 fixed to said cylindrical extensions by a plurality of suitable fastenings (not shown). Cylindrical extensions 25, 26 are made sufficiently thick to accommodate said fastenings. The location of a typical said fastening is depicted as 30 in FIG. 6. The space between the outer surfaces of flanges 30, 29 and the inner surfaces of retaining rings 27, 28 is such that said drum plate is able to rotate independently of said driven plate. In an alternative embodiment (not shown), thin washers of metal or a suitable hard polymer material are positioned to either side of the inner and outer edges of said drum plate between said drum plate and said retaining rings. Said drum plate supports drum 24. As the diameter of said drum is typically less than that of a wheel to which the present invention is fitted, provision is made for said drum plate to rotate at a higher rotational speed than said driven plate. In this embodiment, ring gears 31, 32 of the torque transmitting mechanism are fixed, respectively, to the opposed faces of said driven plate and said drum plate. Coupled gears 33, 34 are fixed to cantilevered common shaft 35 which is rotationally supported in bearing 36. Where a higher rotational speed is required of said drum plate, ring gear 32 and gear 33 are made smaller in diameter and ring gear 31 and gear 34 are made larger in diameter. Thus, where a load is applied to said drum by wheel motion-induced tensioning of said tow cable, said driven plate will rotate at wheel speed and said drum plate will rotate at a higher speed. The sizes of said gears are readily adjusted to provide for rotation of said drum plate at twice the rotational speed of said driven plate. As said drum is typically half the diameter of a wheel to which it is fitted, such an arrangement is able to cause the rate of take-up of a tow cable onto said drum equal to the rate of motion of the parent vehicle with no wheel slip. In an alternative embodiment (not shown), a suitable planetary gear train is provided between said driven plate and said drum plate for the purpose of adjusting the relative rotational speeds of said plates.

With reference to FIG. 5, drum plate 23 is arranged to rotate freely in relation to driven plate 22 in the manner described in relation to FIG. 3. A plurality of sprung pawls 37 is provided fixed to said driven plate, said pawls engaging notches or interdental spaces formed in ring 38 fixed to said drum plate. The orientation of said pawls is such that said drum plate may be rotated by hand by a vehicle operator to take up slack in a tow cable, rotation of said driven plate causing said pawls to lock to ring 38, thereby causing said drum plate and said drum to rotate in unison.

Figure 7:
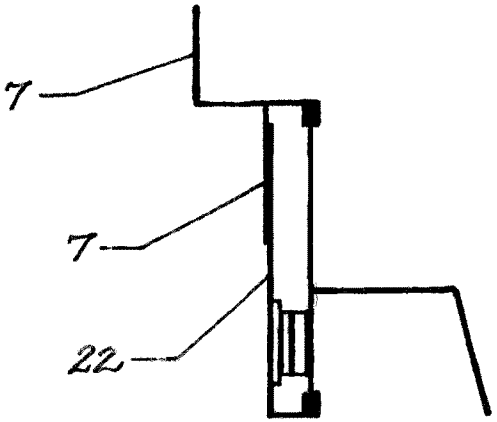
FIG. 7 is a fragmentary face view of ring gear means of the embodiment of FIG. 6.
Figure 7:
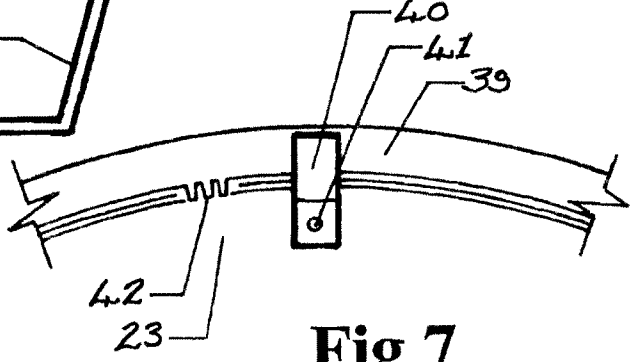

With reference to FIGS. 6 and 7, drum plate 23 is arranged to rotate freely in relation to driven plate 22 in the manner described in relation to FIG. 3. In some embodiments, the slack collector includes a plurality of sprung pawls 37 is provided pivotally supported in yokes 49 fixed to said driven plate, said pawls engaging notches or interdental spaces formed in ring 38 fixed to said drum plate. The orientation of said pawls is such that said drum plate may be rotated by spring force to take up slack in a tow cable, rotation of said driven plate causing said pawls to lock to ring 38, thereby causing said drum plate and said drum to rotate in unison. In this embodiment, ring gear 39 having inwardly-projecting teeth 42 is rotationally supported in a plurality of saddles 40 fixed to said drum plate. The width and separation of said teeth and the width of said saddles is such that several said teeth bear against said saddles at any one time, said teeth thereby being able to move freely over said saddles without catching. One such saddle is adapted to also support a pinion 43 rotationally supported on shaft 44 and turned by handle 45, the end of the shaft of which is removably entered into socket 47 fixed to shaft 44. Ratchet means (not shown) are provided at socket 47 to restrict the rotation of said handle to the appropriate direction and to prevent rotation of said handle under the influence of drum spring 51 (as described in relation to FIG. 6). Said pinion is engaged with teeth 42, rotation of said handle in the permitted sense causing said ring gear to be rotationally displaced in said saddles. The inner end 52 of drum spring 51 is fixed to the outer surface of said ring gear and the outer end 53 of said spring is fixed to said driven plate. Said outer end of said drum spring is fixed to bush 50 pivotally supported on shaft 48 fixed to said driven plate. In an alternative embodiment (not shown), the inner end of said drum spring is fixed to the inner surface of said ring gear by means of a pivoting bush similar to that depicted as 50, pivotal mounting of the ends of said spring preventing localised stressing of the ends of said spring during tensioning. In operation, rotation of said handle in the permitted sense causes said ring gear to rotate, thereby tensioning said drum spring. Should a tow cable wound onto said drum be slack, said drum plate will immediately rotate under the urging of said drum spring to take up said slack. Any subsequent slackening of said cable will be similarly taken up. Obviously, said spring-tensioned drum may be made for clockwise or counter-clockwise rotation.

Figure 8:
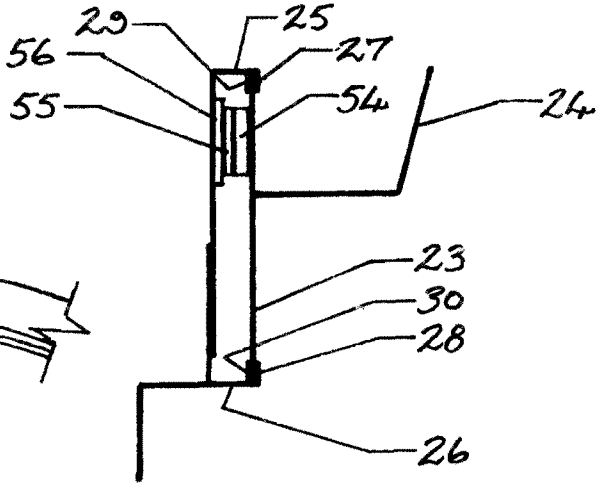
FIG. 8 is a schematic transverse view through a diameter of an embodiment of the present invention.
Figure 10:
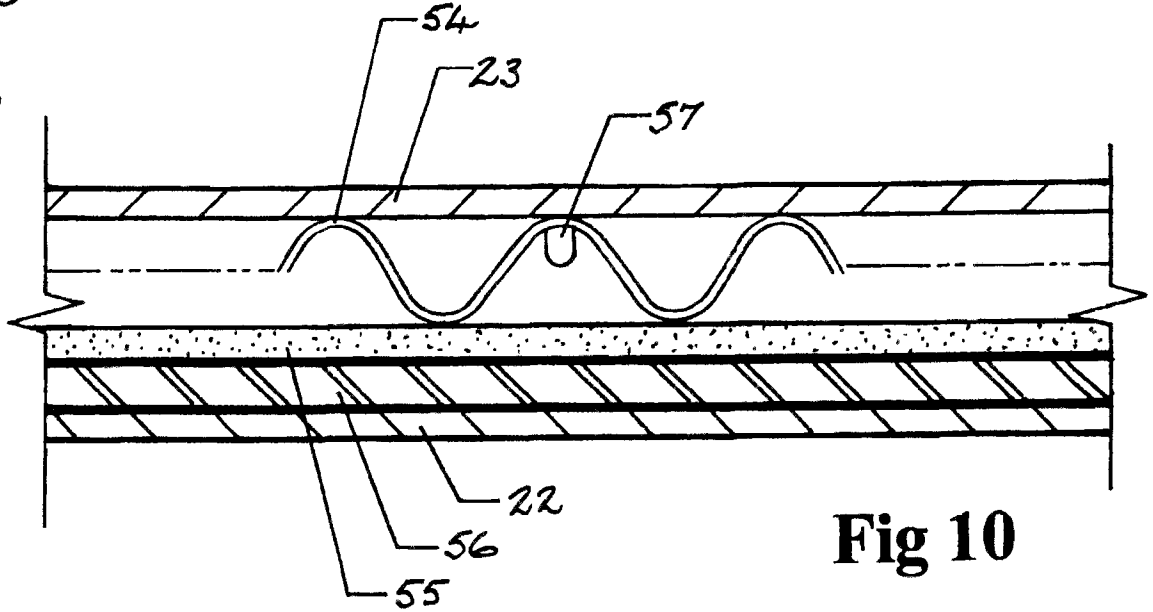
FIG. 10 is a fragmentary transverse cross-sectional view through a circumferential plane of the embodiment of FIG. 8.

With reference to FIGS. 8 and 10, drum plate 23 is arranged to rotate freely in relation to driven plate 22 in the manner described in relation to FIG. 3. In some embodiments, the torque transmitting mechanism includes arcuately-arranged, corrugated spring is made in two circumferential parts each extending approximately throughout half of the circumference of drum plate 23. Each said spring part is located by a centrally-located peg 57 fixed to said drum plate and passing through a neatly fitting aperture and by a peg at each end fixed to said drum plate and passing through circumferentially-slotted apertures to permit extension of the ends of said spring parts as a result of compression. The adjacent ends of said spring parts are separated by sufficient distance to accommodate the maximum expected extension of said spring parts under load. Fixed to said spring parts in their central locations is a ring 55 of frictional material. Said spring urges said frictional material into contact with a ring 56 of frictional surface fixed to driven plate 22. In an alternative embodiment (not shown), said ring of frictional surface is deleted and said frictional material bears directly upon the inner surface of said driven plate. In normal operation, said spring parts, frictional material and friction surface form a clutch which causes said driven plate and said drum plate to rotate in unison. Where an excessive or threshold load is imposed upon the drum of one wheel by its said tow cable, said clutch will slip, thereby permitting load to be transferred to the other wheel. Variation in the load at which said clutch will slip is effected by providing said frictional material of greater or less thickness or of said friction surface of greater or lesser thickness. In the preferred embodiment, said clutch is set to slip at between 0.6 to 0.9 of the force generated by the maximum expected total loading of two said tow cables. In the preferred embodiment, said frictional material is arranged to rub against said driven plate (or against said frictional surface fixed to it) to minimise the amount of heat flowing to said drum plate and thus to said drum. This may be of importance where drums or tow cables made from a polymer material are employed. In an alternative embodiment (not shown), a stiff metal ring is interposed between said spring and said frictional material to support the latter. In another alternative embodiment (not shown), said pegs are extended in length to engage complementary apertures in said frictional material, thereby causing said frictional material to rotate in unison with said drum plate.

Figure 9:
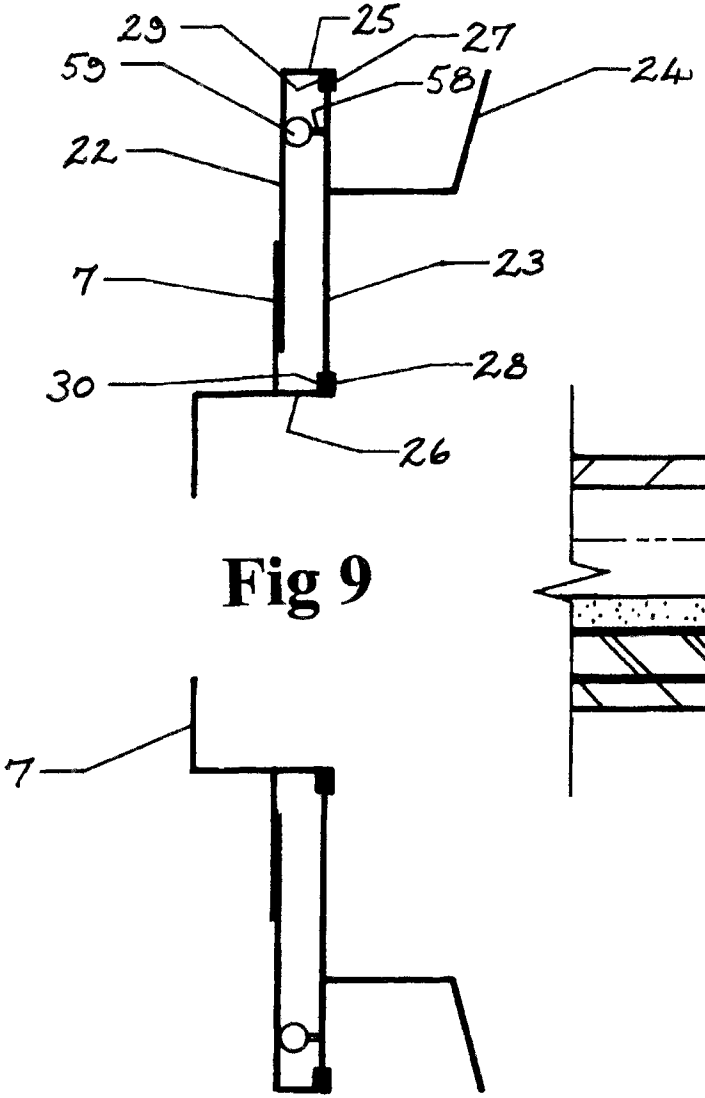
FIG. 9 is a schematic transverse view through a diameter of an embodiment of the present invention.

With reference to FIG. 9, drum plate 23 is arranged to rotate freely in relation to driven plate 22 in the manner described in relation to FIG. 3. In some embodiments, the torque transmitting mechanism includes a plurality of evenly-spaced, arcuately-arranged, tubular spring housings 59 is fixed to the outer, peripheral part of said driven plate, all said housings being positioned on a common circle centred on the axis of rotation of said wheel. Each said spring housing is closed at the ends and is provided with a longitudinally-arranged slot to accommodate struts 58 fixed to said drum plate. The free ends of said struts are provided with more or less circular pads which are free to move in the interior of said spring housings and abut the inner ends of two stiff springs accommodated within each said spring housing. In normal operation, said driven plate and said drum plate rotate in unison with the rotational drive load being taken by said springs. Under shock loadings, said springs are immediately deflected, absorbing said loadings and ameliorating the loading of the other parts of the present invention.

Figures 11, 12:
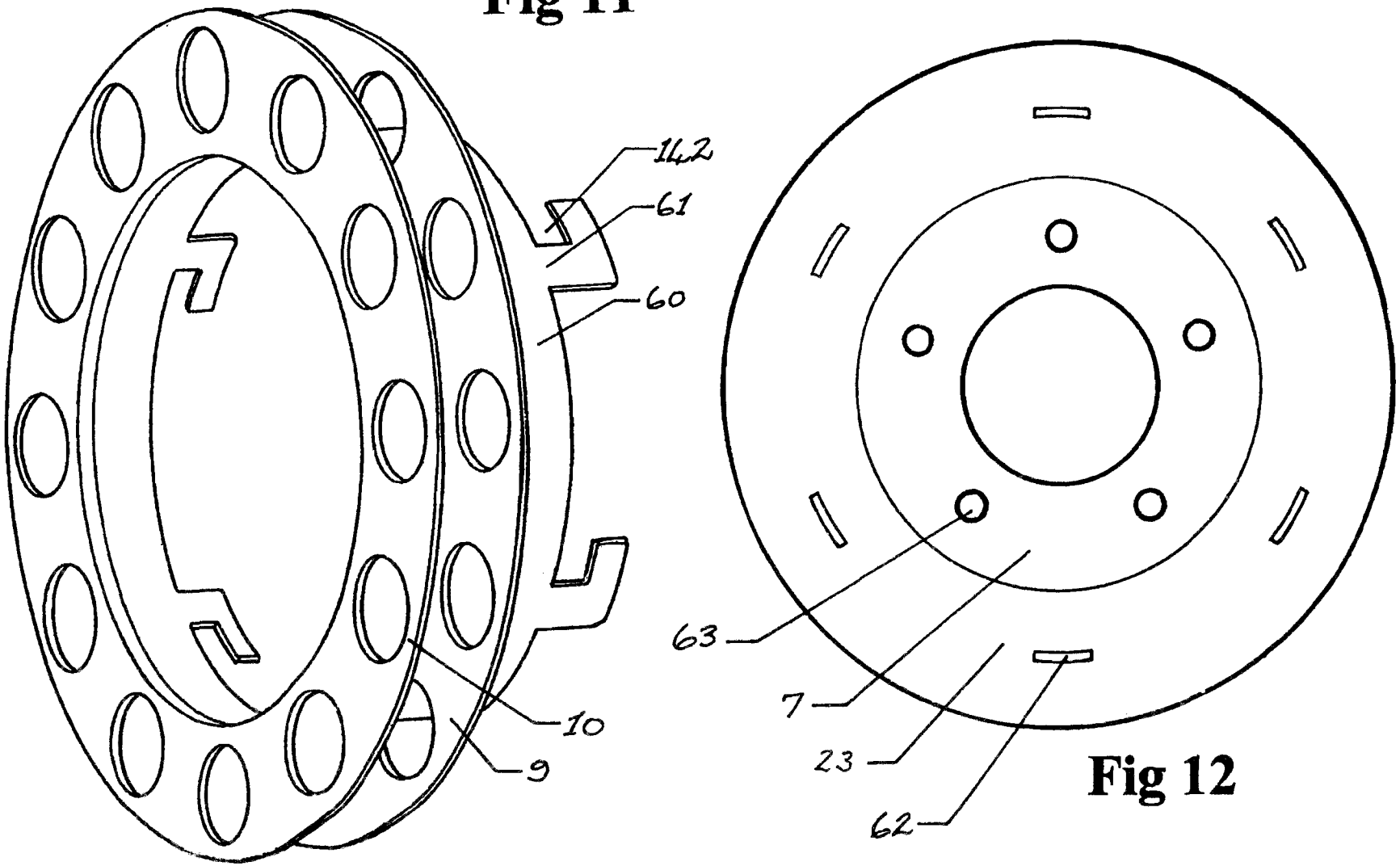
FIG. 11 is an isometric view of an embodiment of the present invention.
FIG. 12 is a face view of an adaptor plate of the present invention adapted to receive the embodiment of FIG. 11.

With reference to FIGS. 11 and 12, drum 9, 10 is made separately from drum plate 23 and is provided on its inner face with inwardly projecting flange 60, formed on the inner edge of which is a plurality of L-shaped projections 61. Said projections are adapted to engage the ends of a plurality of complementary, arcuate slots 62 formed in said drum plate, displacement of said drum in the appropriate sense causing said engagement, thereby attaching said drum to said drum plate and, thus to the wheel of a wheeled vehicle to which said drum plate, said driven plate and said adaptor plate are fixed; rotational loading of said drum in the correct sense positively urging said projections into engagement with the ends of said slots. In an alternative embodiment (not shown), said projections are made T-shaped and are thereby able to be engaged with the ends of said slots of said drum plate by either clockwise or counterclockwise displacement of said drum. The width of gap 142 formed beneath said L-shaped projections is just sufficient to accommodate the thickness of said drum plate in sliding contact. Obviously, said L-shaped projections may be orientated such as to provide engagement with the ends of said drum plate slots via clockwise or counter-clockwise rotation.

Figure 14:
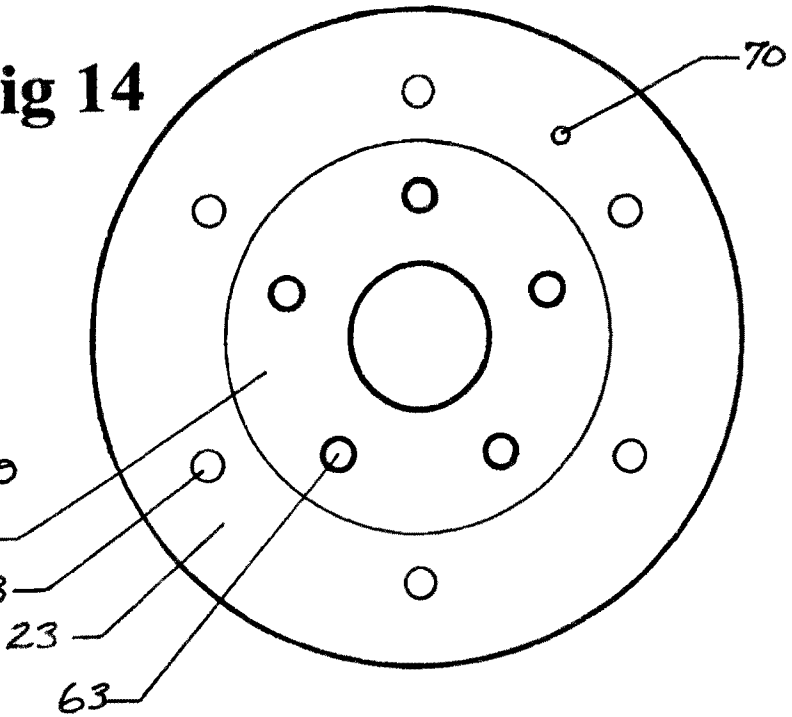
FIG. 14 is a face view of an adaptor plate of the present invention adapted to receive the embodiment of FIG. 13.
Figure 15:
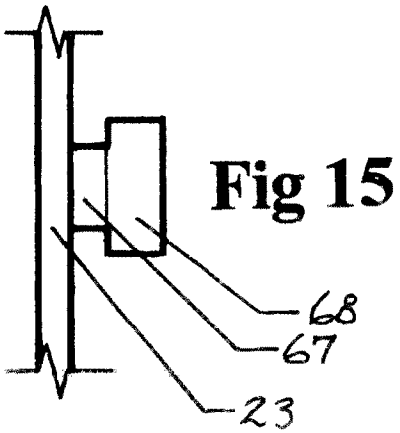
FIG. 15 is a fragmentary longitudinal cross-sectional view of a stud of the embodiment of FIG. 14.
Figure 13:
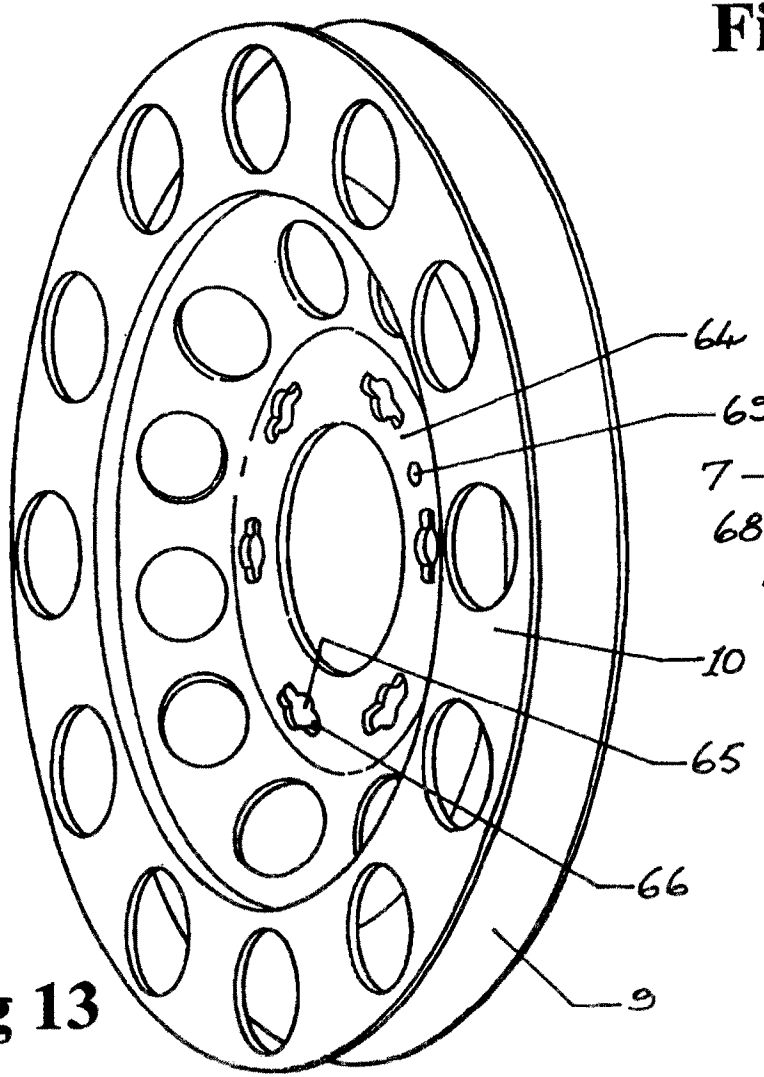
FIG. 13 is an isometric view of an embodiment of the present invention.

With reference to FIGS. 13, 14 and 15, drum 9, 10 is made separately and provided on its inner surface 64 with a plurality of equally-spaced, double keyhole-type apertures comprising a larger centrally-located aperture 65 from which extend short, elongated, circumferentially-arranged, narrow apertures 66. A plurality of complementary, equally-spaced studs 67 having enlarged heads 68 is fixed to the outer surface of drum plate 23. Said apertures and said studs are positioned on circles of the same diameter centred on the axis of rotation of said wheel. Said drum is fixed to said drum plate by passing heads 68 of said studs through apertures 65 and rotating said drum such that studs 67 enter the appropriate narrow apertures 66. To prevent rotation of said drum in relation to said drum plate and, as a result, inadvertent detachment of said drum, a ball-lock pin having a hardened shank is inserted through apertures 69, 70 brought into coincidence by correct positioning of said drum on said drum plate. Obviously, said double keyhole-type apertures may be provided in said drum plate and said studs in said drum on its inner surface. Said apertures to accommodate said ball-lock pins are provided as required to lock said drum onto said drum plate by rotation either in a clockwise or counter-clockwise direction. Obviously, larger apertures 65 may each be made with only one circumferentially-arranged, narrow aperture 66.

Figures 19, 20, 21:
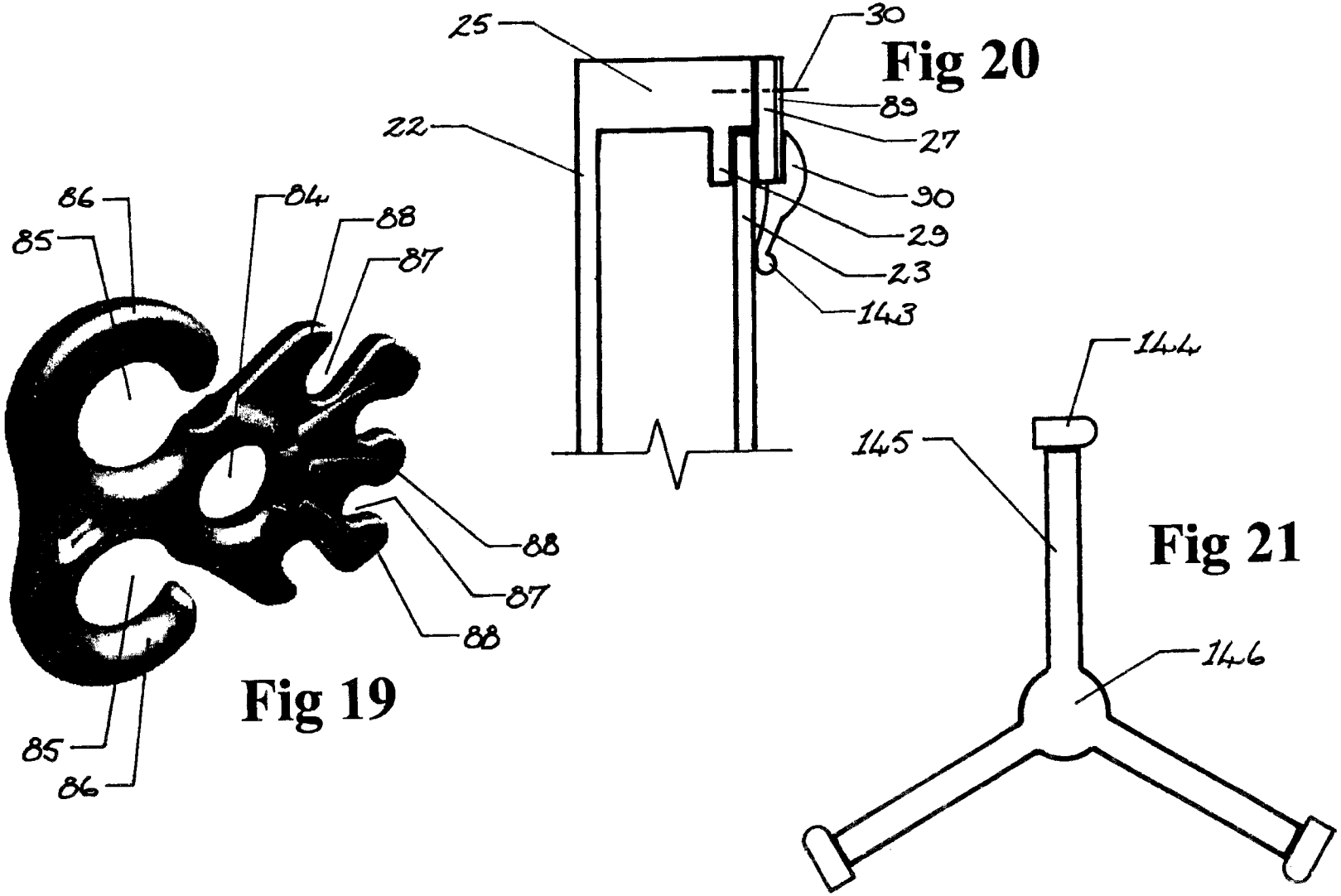
FIG. 19 is an isometric view of tow cable joining means of the present invention.
FIG. 20 is a fragmentary transverse cross-sectional view of a peripheral part of the present invention depicting sealing means.
FIG. 21 is a face view of magnetic blocking means of the present invention.

With additional reference to FIG. 21, two or more rare-earth, metal magnetic blocking plugs 144 are supported at the ends of arms 145 of suitable length, said arms being made from a flexible polymer material. Said arms are fixed to a centrally-located boss 146 which is fitted with a knob (not shown) which may be grasped to manipulate all said blocking plugs simultaneously. The length and angular separation of said arms is such that said blocking plugs are able to be inserted into unoccupied narrow apertures 66 where they are retained by magnetic attraction. The presence of said blocking plugs adjacent said studs prevents said studs from being displaced from their opposed said narrow apertures, thereby preventing said drum from disengaging from said studs.

Figure 17:
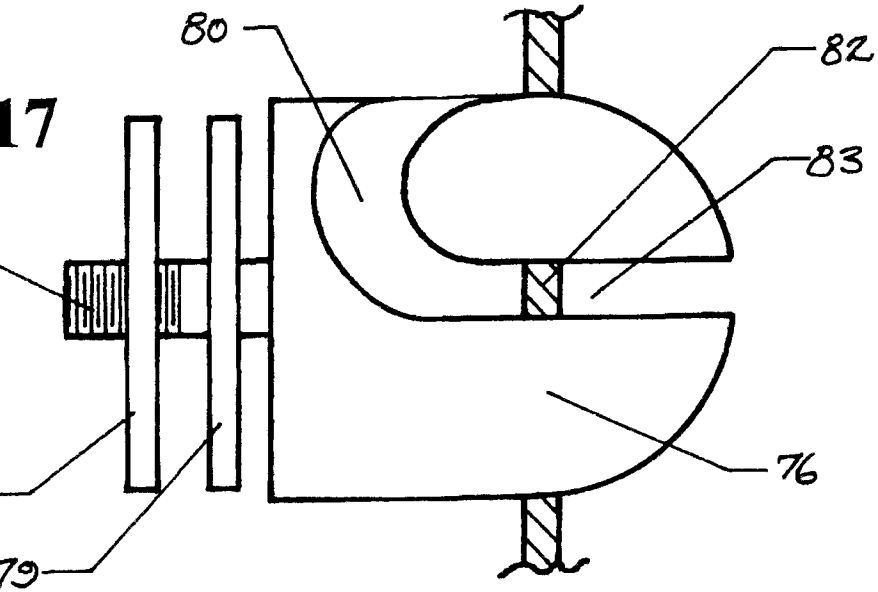
FIG. 17 is a side view of a cable guide of the present invention.
Figure 18:
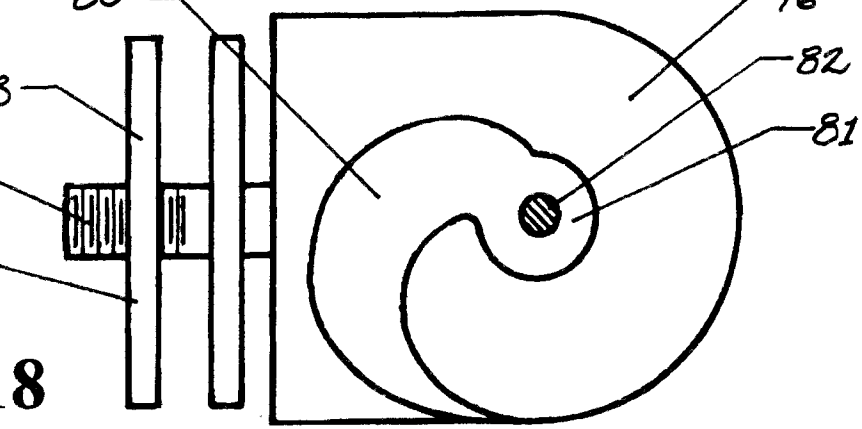
FIG. 18 is a side view of the cable guide of the embodiment of FIG. 17 viewed at 90 degrees rotation.
Figure 16:
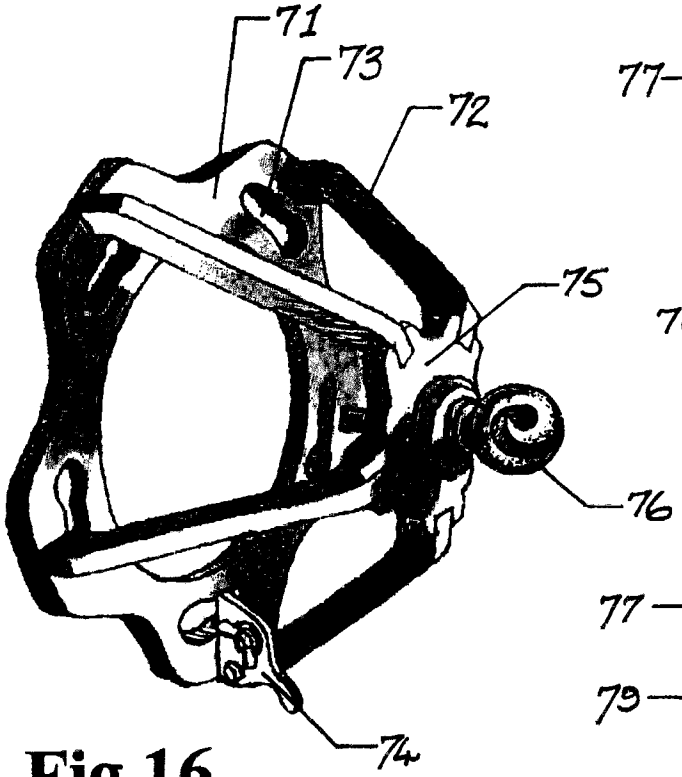
FIG. 16 is an isometric view of means to support a cable guide of the present invention.

With reference to FIGS. 16, 17 and 18, where a tow cable is required to pass the wheels of a vehicle not incorporating said winching means, quickly engaged guiding means are provided. In this embodiment, adaptor plate 7 is fixed to said wheels in the manner described and attachment plate 71 is attached to said adaptor plate. A support comprising three or more legs 72 is fixed to said attachment plate support guide plate 75 clear of each said wheel. Tow cable quick-engagement guide (tow cable guide) 76 is rotationally fixed to the centre of each said guide plate. Said guide is made bullet-shaped with a rounded outer end and a flat inner end. Attachment bolt 77 extends coaxially from said flat inner end and said guide is rotationally fixed to said guide plate by said attachment bolt passing through a centrally-located aperture in said guide plate. Polymer washers 78, 79 are positioned on either side of said guide plate and a self-locking nut (not shown) is screwed onto said bolt with sufficient clearance to allow rotation of said bolt in said guide plate aperture, thereby allowing rotation of said guide. Said guide is made with a centrally-located bore 81 passing through it, said bore guiding tow cable 82. Slot 83 passes axially through said guide normal to said bore and opposed, more or less spirally-arranged channels pass from either side to terminate in said slot. Said tow cable is quickly engaged with said guide by passing it down through a first said spirally-arranged channel, through said slot and out through a second said spirally-arranged channel. Rotational mounting of said guide ensures that said tow cable is unaffected by rotation of a wheel to which said attachment plate is attached.

With reference to FIG. 19, many situations exist in which use of the present invention requires quick joining of tow cables or joining of a tow cable to an anchor point, a cable connector is therefore being provided for this purpose. In this embodiment, a loop at the end of a first said tow cable or anchor bridle is passed through centre hole 84 and is fed through apertures 87 between projections 88, thereby providing high friction. A second said tow cable is attached by passing a loop through apertures 85 between arms 86. Where necessary, a continuous said second tow cable is passed through apertures 85 between arms 86 and thence off to an attachment point in a different direction.

With reference to FIG. 20, drum plate 23 is rotationally sealed to driven plate 22 by provision of softly-flexible sealing means or seal 90 between retaining ring 27 and said drum plate. Said sealing means take the form of a circumferential lip seal 143 fixed to mounting plate 89, said mounting plate being captured against said retaining ring by said plurality of fastenings (typical position depicted as 30 in the figure).

Figures 22, 23, 24, 25:
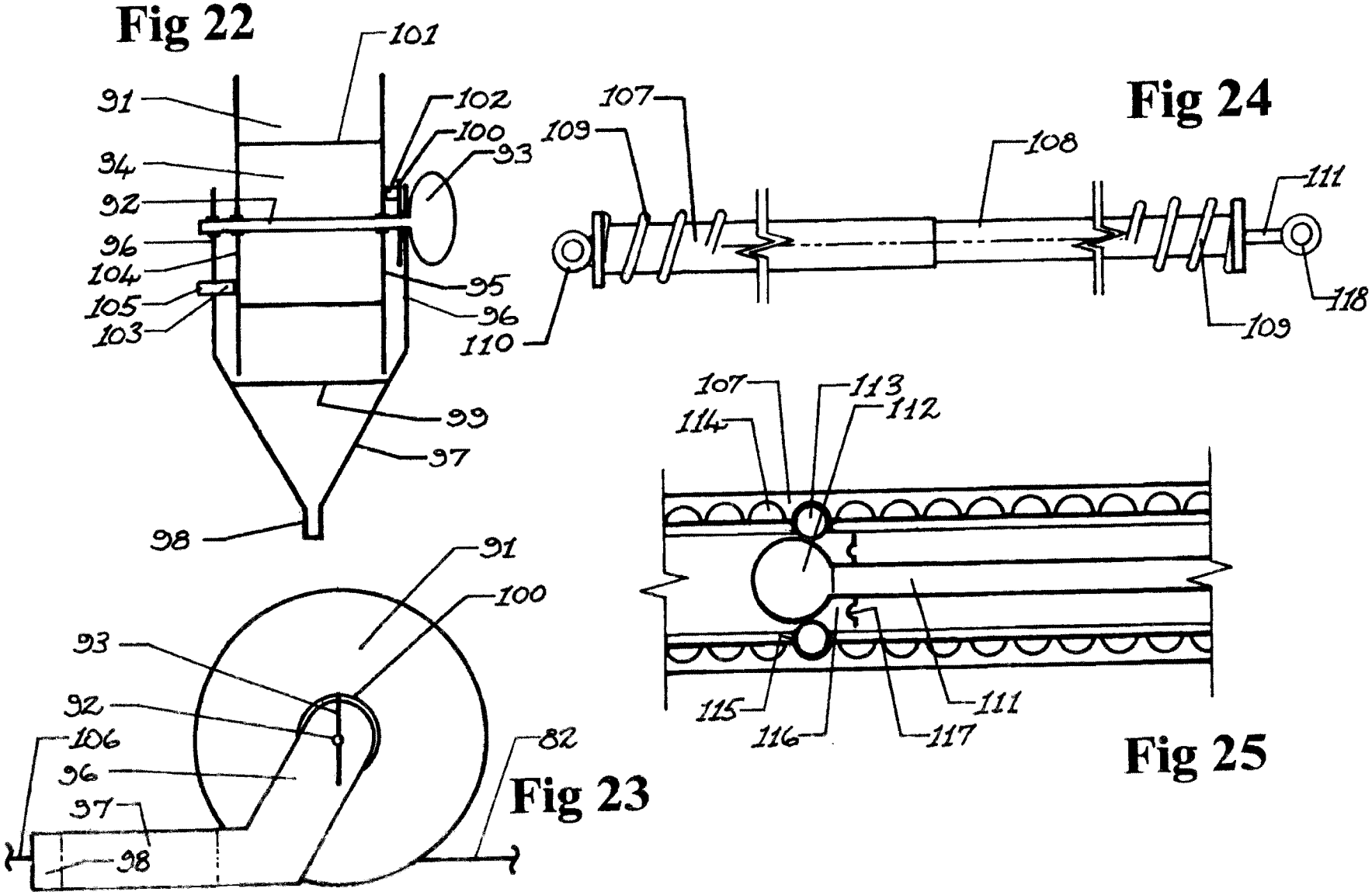
FIG. 22 is a longitudinal cross-sectional view of rotary means to take up tow cable slack during operation of the present invention.
FIG. 23 is a side view of the embodiment of FIG. 22.
FIG. 24 is a side view of linear means to take up tow cable slack during operation of the present invention.
FIG. 25 is a fragmentary longitudinal cross-sectional view of locking means of the embodiment of FIG. 24.

With reference to FIGS. 22 and 23, one embodiment of the slack collector includes discrete, spring-driven, rotary means to take up of slack in a tow cable. In this embodiment, drum 91 is rotationally supported on shaft 92 which is, in turn, rotationally supported in bearings carried in frame 96. Accommodated within drum cylinder 101 is a large clock spring (not shown), the inner end of which is fixed to said shaft and the outer end of which is fixed to the inner surface of said drum cylinder. Said clock spring is tensioned by turning said shaft by means of handle 93, a plurality of sprung pawls 102 fixed to pawl plate 100 which, in turn, is fixed to said shaft, engaging detents (not shown) formed in side wall 95 of said drum cylinder. Said sprung pawls permit said handle to be turned only in the appropriate sense and prevent turning of said handle under the influence of spring tension. Should a tow cable wound onto said drum be slack, said drum plate will immediately rotate under the urging of said clock spring to take up said slack. Any subsequent slackening of said cable will be similarly taken up. A rotational force applied to said drum by tension of a tow cable causes a plurality of sprung pawls 103 to engage detents (not shown) in side wall 96 of said drum cylinder. Sprung pawls 103 are made with projecting heels 105 which are interconnected by means of linkages (not shown), single control means (not shown) being operable to release said pawls and allow the paying out of said tow cable from said drum. Frame 96, 97 is cranked to bring the axis of said tow cable more or less into collinearity with attachment means 106 of said frame. Frame members 97 taper to point 98 to which is attached a cable, chain or the like as a means attaching said frame to anchor means. Transverse strut 99 is provided for the purpose of maintaining frame members 96 in parallel arrangement while they are loaded by tension applied to said drum by said tow cable. Those skilled in the art will appreciate that said spring-driven, rotary tow cable take-up means or slack collector may be readily adapted to provide two discrete drums turning on a common shaft.

With reference to FIGS. 24 and 25, one embodiment of the slack collector includes discrete, spring-driven, linear means to take up of slack in a tow cable. In this embodiment, tubular elements 107, 108 are made telescopic and are urged into telescopic engagement by externally-mounted tension spring 109 fixed to the ends of said tubular elements. Eyes 110, 118 are provided, respectively, at the ends of outer tubular element 107 and draw rod 111, said eyes being employed for attachment of said tow cable and anchor attachment means. Said outer tubular element is provided on its inner surface with a plurality of recesses 114 arranged in circumferential groups. Said inner tubular element is provided with a plurality of apertures 115 extending through its full thickness, said apertures being arranged in a single circumferential group and having a circumferential separation identical to those of recesses 114. A ring of locking balls 113 is provided, the diameter of said locking balls being such as to just fit through apertures 115 and to fit neatly within recesses 114. Draw rod 111 is supported in the end of said inner tubular element such that it is free to move relative to said inner tubular element by a distance of not less than the diameter of one said locking ball and extends substantially throughout the length of said inner tubular element, terminating at its inner end in wedging ball 112. Displacement of said draw rod and said wedging ball within said inner tubular element as a result of tension applied to said tow cable (to the right as depicted in the figure) causes said wedging ball to displace said locking balls radially, out through said apertures and into said recesses, thereby locking said outer tubular element to said inner tubular element. This is the locking position. A suitable draw rod spring is provided to displace said draw rod and said wedging ball to the release position (to the left as depicted in the figure). With said wedging ball in said release position, a force applied to cause telescopic displacement of said tubular elements ejects said locking balls from recesses 114 and partially into space 116 between said wedging ball and diaphragm 117 of a thin, stiffly elastic material fixed to said draw rod adjacent said wedging ball, thereby permitting free telescopic displacement of said tubular members. In said release position, said diaphragm is elastically deflected to accommodate said locking balls. In operation, eye 110 is fixed to an anchor point, draw rod 111 is pushed inwardly to the release position and said inner tubular element is drawn out fully against the urging of spring 109 until it abuts stops (not shown) at the end of said outer tubular element. Said tow cable is then fixed to eye 118 at the end of said draw rod and tensioned, causing said locking ball to assume said locking position. During resumption of said locking position, elastic recovery of said diaphragm to its un-deflected position causes said locking balls to enter apertures 115 from whence they are displaced into recesses 114 by the action of said wedging ball. Any subsequent slackening of said tow cable causes said locking ball to revert to said release position under the influence of said thaw rod spring, permitting said inner tubular element to retract under the influence of tension spring 109 and thereby taking up said slack. The total amount of take-up of said tow cable is obviously determined by the total retraction length of said inner tubular element.

Figure 27:
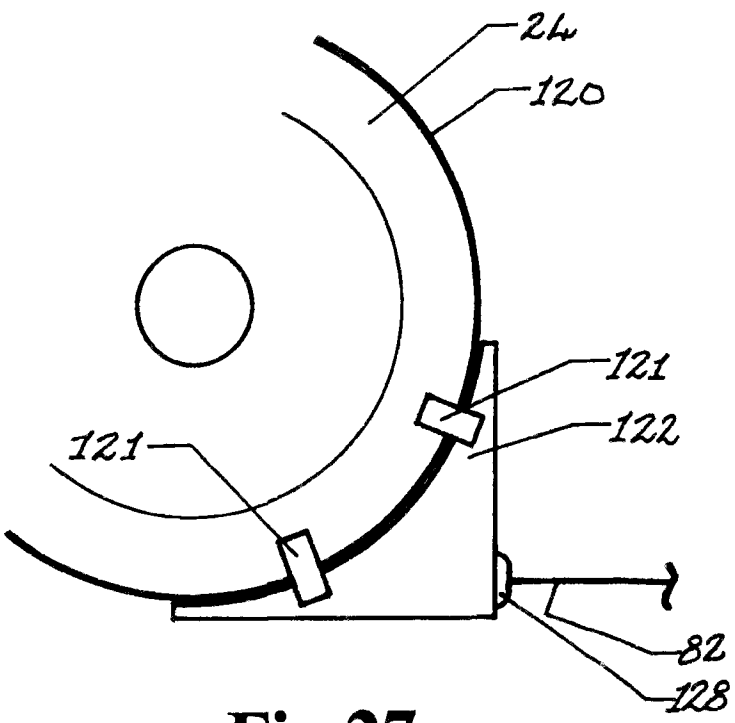
FIG. 27 is a side view of the cable guiding means of the embodiment of FIG. 26.
Figure 26:
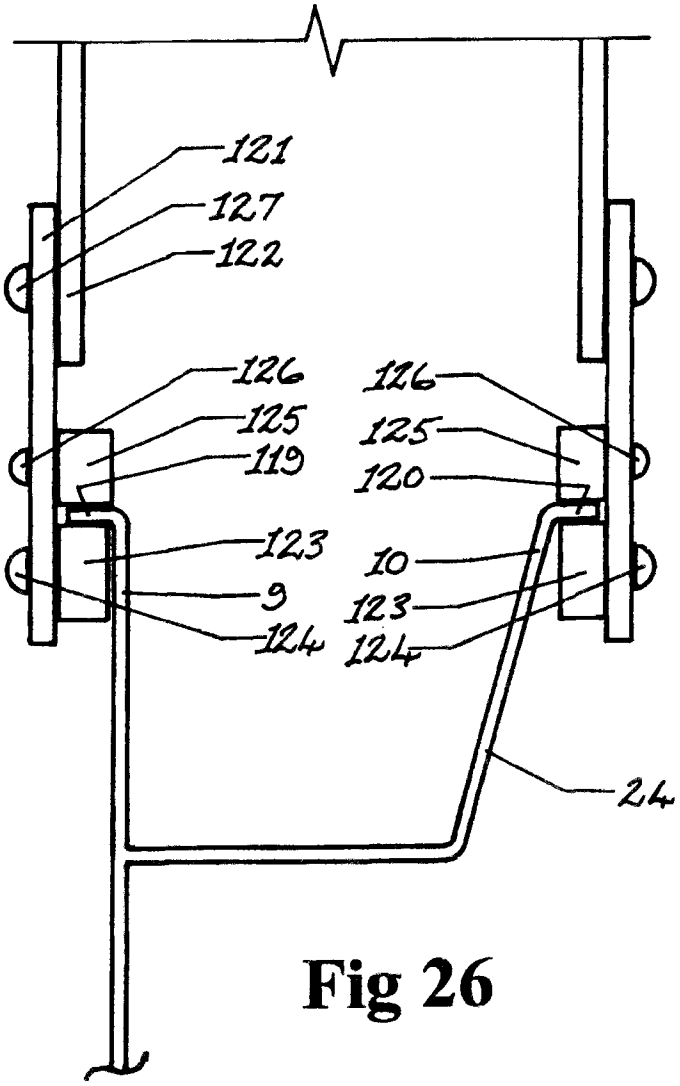
FIG. 26 is a partial transverse cross-sectional view of cable guiding means of the present invention.

With reference to FIGS. 26 and 27, guide means (coil guide) is provided to prevent escape of coils of said tow cable from said drum under circumstances in which said tow cable and drum plane are misaligned. In this embodiment, inner and outer flanges 9, 10 of drum 24 are provided at their outer edges with short roller flanges 119, 120 arranged normal to the plane of said drum. Rollers 123 are rotationally supported on shafts 124 fixed to carriage plates 121, said rollers bearing against the inner surfaces of said roller flanges. Arcuate rubbing strips 125 are fixed to said carriage plates by means of fastenings 126, said rubbing strips making a sliding clearance with the outer surfaces of said roller flanges. In an alternative embodiment (not shown), said rubbing strips are replaced by pairs of rollers positioned to either side of rollers 123. Said carriage plates are fixed to fairlead housing 122 which supports on its outer surface fairlead 128 made of a suitably wear-resistant material. In the preferred embodiment, said fairlead housing is weighted to fall to the position depicted in the figure in which said fairlead is aligned with the point of entry or exit of said tow cable to or from said drum. Obviously, said fairlead is primarily aligned by said tow cable when it is tensioned. In alternative embodiments (not shown), said fairlead housing is made more compact and said fairlead is brought closer to the point of entry or exit of said tow cable to or from said drum.

Figure 28:
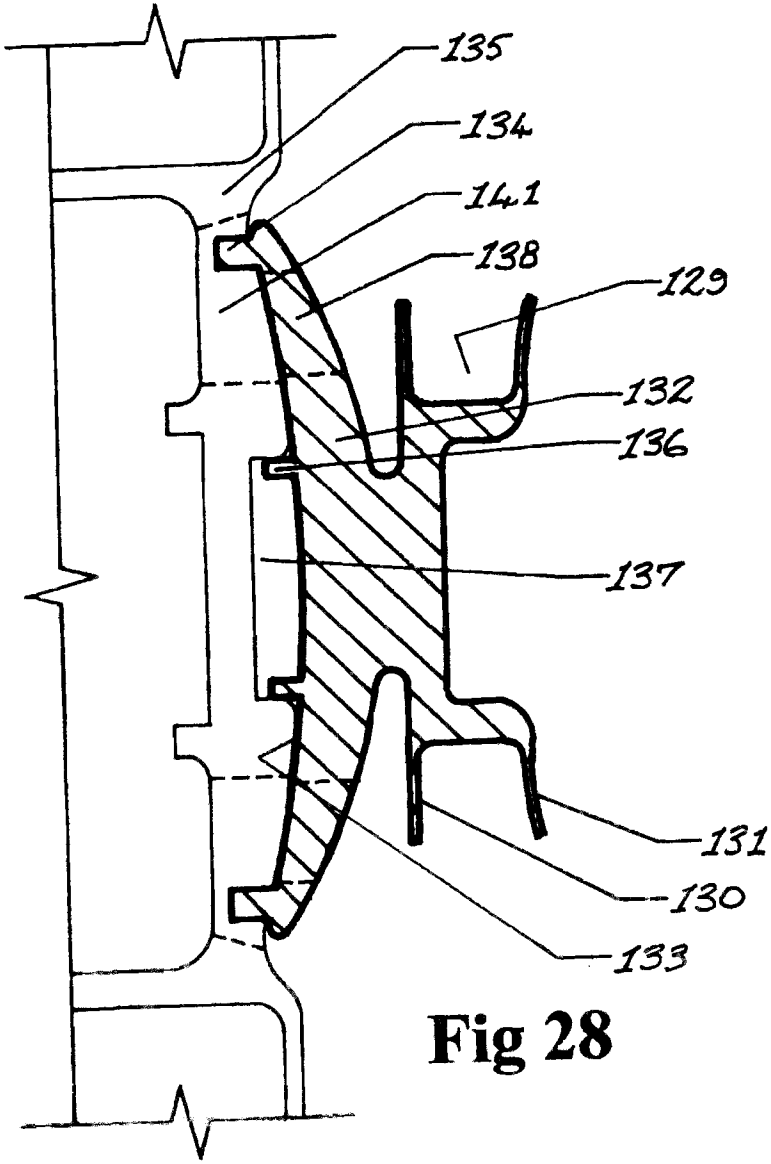
FIG. 28 is a cross-sectional view on a diameter of an alternative embodiment of the present invention.

With reference to FIG. 28, drum 129 comprising inner flange 130 and outer flange 131 is made in a single piece with adaptor plate 132. The inner surface 133 of said adaptor plate is shaped to be complementary to the external shaping of the particular model of wheel 135 (depicted ghosted) to which the present invention is to be adapted. In an alternative embodiment, said adaptor plate inner surface is shaped to contact discrete zones of said wheel external shaping. Circumferential ring 134 is formed on said inner surface of said adaptor plate, said ring being machined away where required to leave projections which enter the spaces (delineated in broken line as 141) between the spokes of said wheel. A layer of a suitable, hard polymer material (not shown) is applied as required to said projections and said inner surface of said adaptor plate, said polymer material acting to prevent marring of the surface of said wheel caused by metal-to-metal contact. Circumferential ring 136 is formed on said inner surface of said adaptor plate, said ring having an external diameter such as to just enter recess 137 of said wheel accommodating wheel attachment studs or bolts and nuts (not shown), said ring acting to centre said adaptor plate on said wheel. In an alternative embodiment (not shown), for the same purpose, where a wheel hub extends outwardly from said wheel, a suitable, centrally-located aperture is provided in said adaptor plate to accommodate said hub. In another alternative embodiment (not shown), for the same purpose, a suitable groove is provided on the inner surface of said adaptor plate to accommodate the outer ends of wheel attachment studs.

Figure 29:
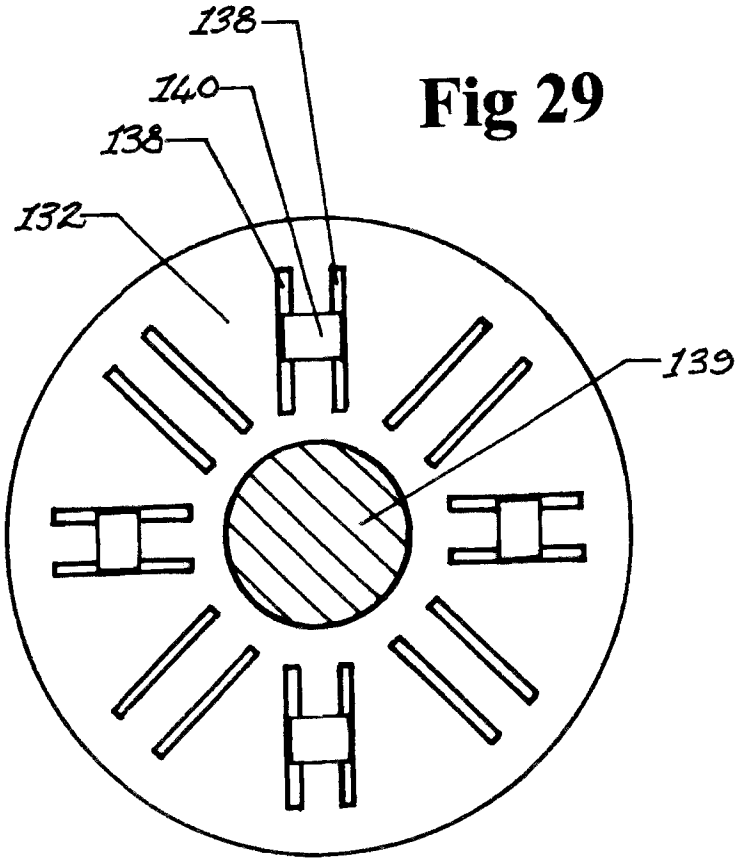
FIG. 29 is an external face view of the adaptor plate of the embodiment of FIG. 28 with the hub of the present invention cut away.

With additional reference to FIG. 29, drum 129 and its flanges 130, 131 are depicted cut away from said adaptor plate leaving material 139 exposed. Pairs of parallel slots 138 are provided in said adaptor plate at radial separations of 45 degrees, 30 degrees or lesser radial separations. The spacing of said slots in a said pair is more or less equal to the width of a spoke of said wheel. With said adaptor plate positioned on said wheel, with said projections engaged between said spokes (thereby positioning a pair of said slots over a spoke) and ring 136 engaged with the edges of recess 137, a strap 140 of a strong, braided polymer material is passed inwardly through one slot of an appropriately positioned said pair, around the adjacent said spoke and outwardly through the other slot of said pair, said strap then being tensioned by means of an over-centre tensioner (not shown). Said tensioners are commonly used in securing load-restraining straps and require no explanation. At least two straps are employed to secure said adaptor plate to said wheel, in the preferred embodiment three or four being employed.

In an alternative embodiment (not shown), said slots are made singly, each said slot accommodating an extended bolt, the inner, threaded ends of said bolts engaging rigid bars spanning the gaps between pairs of said spokes. The outer ends of said bolts are formed into a head adapted to be engaged by a suitable tool, or into a hand wheel to be gripped by hand. To fix the present invention to said wheel, said adaptor plate is positioned on said wheel in the manner described, said rigid bars are positioned individually bridging the gap between two said spokes and said bolts are screwably engaged with threaded apertures of said bars and tightened. In another alternative embodiment (not shown), said singular slots are arranged spirally outwards, or are arranged in circumferential arcs, or are made L-shaped, said slot arrangements permitting a greater flexibility of positioning of said bolts. Said tow cable wound onto said drum of the present invention can take the form of a rope or cable spun or braided from natural fibres, of a cable spun or braided from synthetic fibres, of a wire, of a cable spun or braided from metal wires or filaments, of a chain, or of a combination of any of these.

Obviously, where feasible, where a component is supported from said driven plate and cooperating with a component of said drum plate, the position of said components on said plates may be reversed.

Those skilled in the art will understand that the described methods of attaching said drum and/or said drum plate to said adaptor plate (where necessary via said driven plate) are only some of many possible embodiments and the present invention should be taken to include but not be limited to the use of attachment elements such as lugs, studs, hooks, shaped apertures, recesses, tabs, blades, wedges or the like in one component engaging complementary elements in the other component in a manner permitting rapid and easy engagement and disengagement.

The present invention should be taken to encompass any feasible combination of the features described herein.

The invention claimed is:

1. A multi-functional system for the self-recovery of a wheeled vehicle comprising: a shallow, dished adaptor plate permanently fixed to a driven wheel of a wheeled vehicle by the dished adaptor plate being captured beneath the wheel retaining bolts or nuts; a driven plate driven in rotation by said adaptor plate and a drum plate supported from and driven in rotation by said driven plate via a torque transmitting mechanism situated between said driven plate and said drum plate; provision for the joining together of said driven plate and said drum plate such that said driven plate and said drum plate function as a single element; complementary attachment elements provided on said adaptor plate and said driven plate permitting rapid attachment of said driven plate to said adaptor plate or removal of said driven plate from said adaptor plate; a drum incorporating at least an outer flange and fixed to said drum plate; a tow cable fixed to and wound around said drum; and a tow cable guide supported from a vehicle wheel not fitted with said drum to maintain said tow cable clear of said wheel; wherein when a free end of the tow cable is secured to an anchor point, subsequent driving rotation of said wheel results in the application of tension to said tow cable, thereby assisting in recovery of said vehicle, and axes of rotation of said wheel, adaptor plate, driven plate, drum plate and drum are colinear.

2. The multi-functional system of claim 1, wherein said drum includes an inner flange, and said inner and outer flanges are moulded in monolithic form from a polymer material and fixed to said drum plate.

3. The multi-functional system of claim 1, wherein said tow cable guide comprises a cylindrical body part having a flat inner end part and a bullet-shaped outer end part, said outer end part having a bore and a slot extending diametrically into said outer end part normal to said bore and dividing said outer end part into two parts, said divided parts each having a part-spiral slotting of counter orientation extending into said bore, wherein said tow cable connects with said guide by passing it down through one said spiral slot, across said diametral slot and out through the other said spiral slot, said tow cable being thereby positioned in said bore.

4. The multi-functional system of claim 3, wherein said tow cable guide is supported clear of said wheel on a support having multiple, rigid legs, an attachment bolt extending coaxially from said flat inner end part of said tow cable guide being employed to fix said tow cable guide to said support, said tow cable guide being free to rotate independently of said support, said tow cable thereby being unaffected by rotation of said wheel.

5. The multi-functional system of claim 4, wherein said support comprises an attachment plate fixed in various ways to said wheel and a guide plate supported from said attachment plate clear of said wheel on three or more legs fixed to said attachment plate, said attachment bolt passing through the centre of said guide plate.

6. The multi-functional system of claim 2, wherein, in order to facilitate adaptation of said system to a variety of wheeled vehicles, said drum is made in a standard form and supported from a range of adaptor plate types, each of said type being adapted to be fixed to a particular wheel type.

7. The multi-functional system of claim 4, wherein said driven plate is removably fixed to said adaptor plate by engagement of a plurality of inwardly projecting L-shaped or T-shaped projections provided on an inner surface of said driven plate with a plurality of complementary, arcuate slots formed in said adaptor plate, or by engagement of a plurality of complementary studs with enlarged heads provided on the inner surface of said driven plate with a plurality of complementary single or double keyhole-type apertures formed in said adaptor plate.

8. The multi-functional system of claim 7, wherein said L-shaped or T-shaped projections and said studs with enlarged heads are provided on said adaptor plate and said complementary arcuate slots or said single or double keyhole-type apertures are formed in said driven plate.

9. The multi-functional system of claim 1, wherein said adaptor plate is fixed to the wheel of a vehicle and a circular driven plate positioned parallel to said wheel is removably attached to said adaptor plate; an inner part of said adaptor plate includes a first round, outwardly-projecting, cylindrical extension; a short, raised flange being formed adjacent and parallel to an outer edge of said first cylindrical extension; an outer edge of said driven plate including a second round, outwardly-projecting, cylindrical extension; a short, raised flange being formed adjacent and parallel to an outer edge of said second cylindrical extension, said raised flanges being disposed towards each other; outer faces of the raised flanges being situated in a common plane disposed parallel to said driven plate; peripheral edges of a circular drum plate making sliding clearance with opposed surfaces of said cylindrical extensions and being captured between said first and second raised flanges by annular retaining rings fixed to said cylindrical extensions by a plurality of fasteners, said first and second cylindrical extensions being made sufficiently thick to accommodate said fasteners, a space between the outer faces of said flanges and inner surfaces of said retaining rings being such that said drum plate is able to rotate independently of said driven plate; said drum being fixed to said drum plate; said torque transmitting mechanism comprising ring gears of different diameters fixed to opposed faces of said driven plate, and close-coupled gears of different diameters engaging said drum plate and supported on a cantilevered common shaft rotationally supported in a bearing provided in said driven plate; the diameters of said ring gears and said close-coupled gears being made such that, when a load is applied to said drum by wheel motion-induced tensioning of said tow cable, said driven plate rotates at wheel speed and said drum plate rotates at a higher or lower rotational speed, as required, thereby permitting the rate of take-up of said tow cable onto said drum to be more or less equal to the rate of motion of the parent vehicle without wheel slip.

10. The multi-functional system of claim 9, wherein a planetary gear train is provided between said driven plate and said drum plate and is configured to adjust the relative rotational speeds of said plates.

11. A multi-functional system of claim 1, including:

a slack collector configured to automatically take up slack in the tow cable; and a coil guide configured to prevent the escape of coils of said tow cable from said drum under conditions of misalignment between said tow cable and said drum.

12. The multi-functional system of claim 11, wherein said adaptor plate is fixed to the wheel of a vehicle and a circular driven plate positioned parallel to said wheel is removably attached to said adaptor plate; an inner part of said adaptor plate includes a first round, outwardly-projecting, cylindrical extension; a short, raised flange being formed adjacent and parallel to an outer edge of said first cylindrical extension; an outer edge of said driven plate including a second round, outwardly-projecting, cylindrical extension; a short, raised flange being formed adjacent and parallel to an outer edge of said second cylindrical extension, said raised flanges being disposed towards each other with outer faces of the raised flanges being situated in a common plane disposed parallel to said driven plate; peripheral edges of a circular drum plate making sliding clearance with opposed surfaces of said cylindrical extensions and being captured between said first and second raised flanges by annular retaining rings fixed to said cylindrical extensions by a plurality of suitable fasteners, said first and second cylindrical extensions being made sufficiently thick to accommodate said fasteners, a space between the outer faces of said flanges and inner surfaces of said retaining rings being such that said drum plate is able to rotate independently of said driven plate; said drum being fixed to said drum plate; said slack collector including a plurality of sprung pawls pivotally supported in yokes fixed to said driven plate, said pawls engaging notches or interdental spaces formed in a ring fixed to said drum plate, the orientation of said pawls being such that said drum plate may be rotated by the urging of a spring to take up slack in said tow cable, rotation of said driven plate by said wheel causing said pawls to lock to said ring, thereby causing said driven plate and said drum plate to rotate in unison; an outer end of said spring being fixed to said drum plate, said spring being tensioned by rotation of a ring gear to which an inner end of the spring is fixed, said ring gear being rotated by means of a pinion fixed to a shaft turned by a removable handle, ratchet means being employed to restrict rotation of said handle and to prevent rotation of said handle under the influence of the tension of said spring.

13. The multi-functional system of claim 1, wherein said adaptor plate is fixed to the wheel of a vehicle and a circular driven plate positioned parallel to said wheel is removably attached to said adaptor plate; an inner part of said adaptor plate includes a first round, outwardly-projecting, cylindrical extension; a short, raised flange being formed adjacent and parallel to an outer edge of said first cylindrical extension; an outer edge of said driven plate including a second round, outwardly-projecting, cylindrical extension; a short, raised flange being formed adjacent and parallel to an outer edge of said second cylindrical extension, said raised flanges being disposed towards each other; outer faces of the raised flanges being situated in a common plane disposed parallel to said driven plate; peripheral edges of a circular drum plate making sliding clearance with opposed surfaces of said cylindrical extensions and being captured between said first and second raised flanges by annular retaining rings fixed to said cylindrical extensions by a plurality of fasteners, said first and second cylindrical extensions being made sufficiently thick to accommodate said fasteners, a space between the outer surfaces of said flanges and inner surfaces of said retaining rings being such that said drum plate is able to rotate independently of said driven plate; said drum being fixed to said drum plate; the torque transmitting mechanism comprising an arcuately-arranged, corrugated spring made in two circumferential spring parts being positioned between said driven plate and said drum plate, each of said spring parts extending approximately throughout half of a circumference of said drum plate, each of said spring part being located by a centrally-located peg fixed to said drum plate and passing through an aperture and by a peg at each end fixed to said drum plate and passing through circumferentially-slotted apertures to permit extension of ends of said spring parts as a result of compression, adjacent ends of said spring parts being separated by sufficient distance to accommodate a maximum expected extension of said spring parts under load; the torque transmitting mechanism further comprising a ring of frictional material being fixed to central locations of said spring parts, said spring urging said frictional material into contact with a ring of frictional surface fixed to said driven plate, said spring parts, frictional material and friction surface forming a clutch which causes said driven plate and said drum plate to rotate in unison; slippage of said clutch acting to prevent the imposition of an excessive load upon the drum by said tow cable.

14. The multi-functional system of claim 13, wherein a threshold load at which said clutch will slip is dependent upon said frictional material in greater or lesser thickness or of said frictional surface in greater or lesser thickness.

15. The multi-functional system of claim 13, wherein variation said clutch is set to slip at between 0.6 to 0.9 of the force generated by a maximum expected total loading.

16. The multi-functional system of claim 13, wherein said frictional material is arranged to rub against said driven plate or against said frictional surface fixed to said driven plate, thereby minimizing the amount of heat flowing to said drum plate from said clutch.

17. The multi-functional system of claim 13, wherein a stiff metal ring is interposed between said spring and said frictional material to support the latter.

18. The multi-functional system of claim 13, wherein said pegs locating said spring parts are extended in length to engage complementary apertures in said frictional material.

19. The multi-functional system of claim 1 in which said adaptor plate is fixed to the wheel of a vehicle and a circular driven plate positioned parallel to said wheel is removably attached to said adaptor plate; an inner part of said adaptor plate includes a first round, outwardly-projecting, cylindrical extension; a short, raised flange being formed adjacent and parallel to an outer edge of said first cylindrical extension; an outer edge of said driven plate including a second round, outwardly-projecting, cylindrical extension; a short, raised flange being formed adjacent and parallel to an outer edge of said second cylindrical extension, said raised flanges being disposed towards each other; outer faces of the raised flanges being situated in a common plane disposed parallel to said driven plate; peripheral edges of a circular drum plate making sliding clearance with opposed surfaces of said cylindrical extensions and being captured between said first and second raised flanges by annular retaining rings fixed to said cylindrical extensions by a plurality of fasteners, said first and second cylindrical extensions being made sufficiently thick to accommodate said fasteners, a space between the outer faces of said flanges and inner surfaces of said retaining rings being such that said drum plate is able to rotate independently of said driven plate; said drum being fixed to said drum plate; said torque transmitting mechanism comprising a plurality of evenly-spaced, arcuately-arranged, tubular spring housings being fixed to said driven plate, each of said spring housings, having closed ends and including a longitudinally-arranged slot to accommodate struts fixed to said drum plate, free ends of said struts including pads that are free to move in an interior of said spring housings and abut inner ends of two stiff springs accommodated within each of said spring housings, wherein said driven plate and said drum plate are configured to rotate in unison with a rotational drive load being taken by said springs which, under shock loadings, are immediately deflected, absorbing said shock loadings and ameliorating the loads applied to other parts.

20. The multi-functional system of claim 1, wherein said drum is made separately from said drum plate, an inner face of the drum includes an inwardly projecting, cylindrical flange; an inner edge of the cylindrical flange includes a plurality of L-shaped projections, said projections being adapted to engage the ends of a plurality of complementary arcuate slots formed in said drum plate, a width of a gap between feet of said L-shaped projections and the inner edge of said cylindrical flange being sufficient to accommodate a thickness of said drum plate in sliding contact, displacement of said drum causing said engagement, thereby attaching said drum to said drum plate and to said wheel of the wheeled vehicle via said driven plate and said adaptor plate; rotational loading of said drum positively urging said projections into engagement with the ends of said slots.

21. The multi-functional system of claim 20, wherein said projections of said drum cylindrical flange are made T-shaped and are thereby able to be engaged with either end of said slots of said drum plate by either clockwise or counterclockwise displacement of said drum, the width of the gap between the feet of said T-shaped projections and the edge of said cylindrical flange being sufficient to accommodate the thickness of said drum plate in sliding contact.

22. The multi-functional system of claim 1, wherein said drum is made separately from said drum plate, an inner surface of the drum includes a plurality of equally-spaced, double keyhole-type apertures comprising a larger centrally-located aperture from which extend short, elongated, circumferentially-arranged, narrow apertures; a plurality of complementary, equally-spaced studs having enlarged heads being fixed to an outer surface of said drum plate, said studs being positioned on a circle having a diameter that is equal to that upon which said larger apertures are located; said drum being fixed to said drum plate and, thereby, to the wheel of the wheeled vehicle by passing said enlarged heads of said studs through said larger apertures and rotating said drum such that said studs enter the appropriate said narrow apertures; to prevent rotation of said drum in relation to said drum plate and, as a result, inadvertent detachment of said drum, a ball-lock pin having a hardened shank is inserted through complementary apertures brought into coincidence by correct positioning of said drum on said drum plate.

23. The multi-functional system of claim 22, wherein said double keyhole-type apertures are provided in said drum plate and said studs on the inner surface of said drum.

24. The multi-functional system of claim 22, wherein said apertures have a single keyhole-type form having only one circumferentially-arranged, said narrow aperture.

25. The system of claim 1, including a cable connector attached to the tow cable for joining tow cables or for joining of a tow cable to an anchor point, said cable connector comprising a plate having a central hole and, at a first end, a plurality of short projections separated by smaller open apertures of sufficient width to accommodate said tow cable and, at a second end, two curved arms creating larger open apertures able to accommodate at least four thicknesses of said tow cable; a loop at the end of said tow cable or anchor bridle being passed through said central hole and led through successive said smaller open apertures between said short projections, thereby providing high friction, a second tow cable being attached by passing a loop of said second tow cable through said larger apertures between said curved arms.

26. The system of claim 25 in which a portion of said second tow cable is passed through said larger apertures between said curved arms and thence off to an attachment point in a different direction.

27. The multi-functional system of claim 9, wherein said drum plate is rotationally sealed to said driven plate by softly-flexible seal, said seal comprising circumferential lip seals fixed to annular mounting plates secured to said annular retaining rings by the fasteners securing said annular retaining rings to said cylindrical extensions.

28. The system of claim 11, wherein the slack collector comprises a cylinder rotationally supported on a shaft, a large clock spring being accommodated within said cylinder, an inner end of said clock spring fixed to said shaft and an outer end of said clock spring fixed to an inner surface of said cylinder; said clock spring being tensioned by turning said shaft by means of a handle; the slack collector including a plurality of sprung pawls fixed to a pawl plate which is, in turn, fixed to said shaft, engaging detents formed in the end wall of said cylinder, said sprung pawls permitting said handle to be turned only in one direction and prevent turning of said handle under the influence of tension of said clock spring; any slack developing in the tow cable wound onto said cylinder immediately being taken up by rotation of said cylinder under the urging of said clock spring, a rotational force applied to said cylinder by tension of said tow cable causing said sprung pawls to engage said detents, thereby preventing rotation of said cylinder; a frame supporting said shaft and transferring tow loads to the shaft being cranked to bring an axis of said tow cable more or less into collinearity with an attachment point of said frame.

29. The system of claim 28, wherein said sprung pawls are made with projecting heels which are interconnected by means of linkages, and said pawls being releasable to allow feeding of said tow cable from said cylinder.

30. The system of claim 28, wherein said slack collector includes two discrete drums turning on a common shaft.

31. The system of claim 11, wherein the slack collector comprises inner and outer tubular elements urged into telescopic engagement by an externally-mounted tension spring fixed to ends of the tubular elements, eyes configured for attachment of said tow cable are provided at an end of the outer tubular element and at an end of a draw rod supported in an end of the inner tubular element; said outer tubular element being provided on its inner surface with a plurality of recesses arranged in a plurality of circumferential groups, said inner tubular element being provided with a plurality of apertures in a single circumferential group extending through a full thickness of the inner tubular element, said apertures having a circumferential separation identical to those of said recesses, a ring of locking balls being provided having diameters such as to just fit through said apertures and to fit neatly within said recesses; said draw rod being free to move within the end of said inner tubular element by a distance of not less than a diameter of one of said locking balls, extending substantially throughout a length of said inner tubular element and terminating at its inner end is a wedging ball having a diameter greater than that of a circle touching inner edges of said locking balls when in outwardly displaced positions; displacement of said draw rod, and thereby said wedging ball, as a result of tension applied to said tow cable causing said wedging ball to displace said locking balls radially, through said apertures and into said recesses to assume a locking position, in which said outer tubular element is locked to said inner tubular element; a draw rod spring being provided to displace said draw rod and said wedging ball to a release position away from said ring of locking balls such that a force applied by said externally mounted tension spring causes telescopic displacement of said tubular elements and ejects said locking balls from said recesses and partially into a space adjacent to said wedging ball to assume a release position in which the locking balls elastically displace a diaphragm of a thin, stiffly elastic material fixed to said draw rod adjacent said wedging ball, thereby permitting free telescoping of said tubular elements; wherein when said eye on the end of said outer tubular element is fixed to an anchor point, said draw rod is pushed inwardly into said inner tubular element to release said locking balls and said inner tubular element is drawn out fully against the urging of said externally mounted tension spring until it abuts and stops at the end of said outer tubular element, when said tow cable is fixed to said eye at the end of said draw rod and tensioned, said draw rod is outwardly displaced, thereby causing said locking balls to reassume said locking position, during resumption of said locking position elastic recovery of said diaphragm to its un-deflected position causes said locking balls to re-enter said apertures and into said recesses by the action of said wedging ball; any subsequent slackening of said tow cable causes said draw rod and said locking ball to be displaced inwardly under the influence of said draw rod spring, permitting said locking balls to revert to said release position and permitting said inner tubular element to retract under the influence of said externally mounted tension spring, thereby taking up said slack, a total length of take-up of said tow cable slack being determined by a total retraction length of said inner tubular element.

32. The multi-functional system of claim 11, wherein the coil guide comprises a fairlead housing supporting a fairlead formed of a wear-resistant material, said fairlead housing being slidingly supported on rollers and rubbing strips travelling on roller flanges formed on an outer edge the outer flange of the drum and/or on an outer edge of an inner flange of the drum, said fairlead housing being weighted to fall to a position in which said fairlead is more or less aligned with a point of entry or exit of said tow cable to or from said drum.

33. A multi-functional system for the self-recovery of a wheeled vehicle comprising:

an adaptor plate;

a driven plate configured to rotate in response to rotation of said adaptor plate;

a drum plate supported by the driven plate;

a torque transmitting mechanism situated between said driven plate and said drum plate and configured to limit a torque applied to the drum plate from the driven plate, wherein rotation of the adapter plate and the driven plate drives rotation of the drum plate through the torque transmitting mechanism, and the torque transmitting mechanism allows the drum plate to rotate at a different rotational speed than the driven plate;

a drum attached to said drum plate and including an outer flange;

a tow cable fixed to and wound around said drum; and a slack collector configured to automatically take up slack in the tow cable, wherein when a free end of the tow cable is attached to an anchor point, and the adapter plate is attached to a driven wheel of a wheeled vehicle, the adapter plate and the driven plate rotate with rotation of the driven wheel, which drives rotation of the drum plate and drum through the torque transmitting mechanism, which results in the application of tension to said tow cable that is limited by the torque transmitting mechanism.

34. The multi-functional system of claim 11, wherein said adaptor plate is fixed to the wheel of a vehicle, and a circular driven plate positioned parallel to said wheel is removably attached to said adaptor plate; an inner part of said adaptor plate includes a first round, outwardly-projecting, cylindrical extension; a short, raised flange being formed adjacent and parallel to an outer edge of said first cylindrical extension; an outer edge of said driven plate including a second round, outwardly-projecting, cylindrical extension; a short, raised flange being formed adjacent and parallel to an outer edge of said second cylindrical extension, said raised flanges being disposed towards each other outer faces of the raised flanges being situated in a common plane disposed parallel to said driven plate; peripheral edges of a circular drum plate making sliding clearance with opposed surfaces of said cylindrical extensions and being captured between said first and second raised flanges by annular retaining rings fixed to said cylindrical extensions by a plurality of fasteners, said first and second cylindrical extensions being made sufficiently thick to accommodate said fasteners, a space between the outer faces of said flanges and inner surfaces of said retaining rings being such that said drum plate is able to rotate independently of said driven plate; said drum being fixed to said drum plate; said slack collector including a plurality of sprung pawls fixed to said driven plate, said pawls engaging notches or interdental spaces formed in a ring fixed to said drum plate, the orientation of said pawls being such that said drum plate may be rotated by hand by a vehicle operator to take up slack in said tow cable, rotation of said driven plate by said wheel causing said pawls to lock to said ring, thereby causing said driven plate and said drum plate to rotate in unison.

* * * * *